US010752002B2

(12) United States Patent
Kudo et al.

(10) Patent No.: US 10,752,002 B2
(45) Date of Patent: Aug. 25, 2020

(54) LIQUID EJECTING APPARATUS WITH SPILL CATCHING MECHANISM

(71) Applicant: SEIKO EPSON CORPORATION, Tokyo (JP)

(72) Inventors: Shoma Kudo, Shiojiri (JP); Naomi Kimura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 66 days.

(21) Appl. No.: 16/199,953

(22) Filed: Nov. 26, 2018

(65) Prior Publication Data

US 2019/0160822 A1 May 30, 2019

(30) Foreign Application Priority Data

Nov. 28, 2017 (JP) ..... 2017-228081

(51) Int. Cl.

| | |
|---|---|
| ***B41J 2/175*** | (2006.01) |
| ***B41J 2/135*** | (2006.01) |
| ***B41J 29/13*** | (2006.01) |
| ***B41J 29/02*** | (2006.01) |

(52) U.S. Cl.

CPC ..... *B41J 2/17506* (2013.01); *B41J 2/135* (2013.01); *B41J 2/17509* (2013.01); *B41J 2/17513* (2013.01); *B41J 2/17553* (2013.01); *B41J 29/02* (2013.01); *B41J 29/13* (2013.01)

(58) Field of Classification Search

CPC .... B41J 2/17506; B41J 2/17509; B41J 29/13; B41J 29/02; B41J 2/135; B41J 2/17513; B41J 2/17553

See application file for complete search history.

(56) References Cited

U.S. PATENT DOCUMENTS

| | | | | |
|---|---|---|---|---|
| 2005/0156985 | A1* | 7/2005 | Silverbrook | B41J 2/04541 347/20 |
| 2011/0285797 | A1* | 11/2011 | Ogura | B41J 2/17513 347/86 |
| 2016/0009096 | A1* | 1/2016 | Suzuki | B41J 29/13 347/86 |
| 2017/0120613 | A1* | 5/2017 | Ikebe | B41J 29/02 |

FOREIGN PATENT DOCUMENTS

| | | | |
|---|---|---|---|
| JP | 08-150728 | A | 6/1996 |

* cited by examiner

*Primary Examiner* — Henok D Legesse
(74) *Attorney, Agent, or Firm* — Oliff PLC

(57) ABSTRACT

Provided is a liquid ejecting apparatus that can reduce situations where surrounding areas are soiled by spilled liquid.

The liquid ejecting apparatus includes: a liquid tank 47, the liquid tank 47 being mounted in a carriage 20 configured to move back and forth in the X axis direction, and the liquid tank 47 including a liquid resupply unit 23 configured to accept resupply of a liquid from the exterior; and a housing 48 configured to cover the liquid tank 47. The housing 48 includes: an upper wall 49 that covers the liquid tank 47 from the upper side; and a first recess part 61 and a second recess part 62, which are provided in the upper wall 49 to receive a spilled liquid that has spilled to the exterior of the liquid resupply unit 23, and which are recessed downward.

20 Claims, 18 Drawing Sheets

LIQUID EJECTING APPARATUS WITH SPILL CATCHING MECHANISM

BACKGROUND

1. Technical Field

The present invention relates to a liquid ejecting apparatus such as a printer.

2. Related Art

Ink jet recording apparatuses that record (print) onto a recording medium by discharging (ejecting) ink (a liquid), which is supplied from an ink tank (a liquid tank), from a mobile carrier head can be given as examples of liquid ejecting apparatuses. Some such recording apparatuses are provided with an ink tank, in which an ink receiving port (a liquid resupply unit) for resupplying ink is formed, in the carrier head (see JP-A-8-150728, for example).

Ink is resupplied to an ink tank while the ink tank is mounted in the carrier head. If ink spills out from the ink receiving port, the spilled ink will land on the ink tank, the carrier head, or the like. If the ink tank and the carrier head then move, there is a risk that the ink that has landed will scatter to the surrounding area and soil the surrounding area.

This problem is not limited to recording apparatuses including a mobile ink tank mounted in a carrier head, and generally occurs in all liquid ejecting apparatuses including a mobile liquid tank mounted in a carriage.

SUMMARY

An advantage of some aspects of the invention is to provide a liquid ejecting apparatus that can reduce situations where surrounding areas are soiled by spilled liquid.

Aspects for solving the above-described problems, as well as actions and effects thereof, will be described hereinafter.

A liquid ejecting apparatus according to an aspect of the invention is a liquid ejecting apparatus, wherein assuming three spatial axes orthogonal to one another are an X axis, a Y axis, and a Z axis, directions following the X axis, the Y axis, and the Z axis are an X axis direction, a Y axis direction, and a Z axis direction, respectively, positive directions following the X axis, the Y axis, and the Z axis are a +X axis direction, a +Y axis direction, and a +Z axis direction, respectively, negative directions following the X axis, the Y axis, and the Z axis are a −X axis direction, a −Y axis direction, and a −Z axis direction, respectively, and the vertical direction is the −Z axis direction, the liquid ejecting apparatus includes: a liquid tank, the liquid tank being mounted in a carriage configured to move back and forth in the X axis direction, and the liquid tank including a liquid resupply unit configured to accept resupply of a liquid from the exterior; and a housing configured to cover the liquid tank, wherein the housing includes: a covering part that covers the liquid tank from the +Z axis direction; and a recess, the recess being provided in the covering part to receive a spilled liquid that has spilled to the exterior of the liquid resupply unit, and the recess being recessed in the −Z axis direction.

According to this configuration, the housing includes the recess provided in the covering part. Accordingly, the spilled liquid that has spilled to the exterior of the liquid resupply unit can be taken into the recess. Situations where the surrounding areas are soiled by the spilled liquid can therefore be reduced.

In a liquid ejecting apparatus according to another aspect of the invention, preferably, the covering part includes: an opening, the opening being provided in the recess to allow the liquid to pass in the −Z axis direction; and a groove, the groove being provided oriented toward the recess or the opening to guide the spilled liquid to the opening, wherein the liquid tank includes a liquid receiving part that receives the spilled liquid in at least part of the +Z axis direction.

According to this configuration, the covering part includes the opening provided in the recess, and the groove provided oriented toward the recess or the opening. Accordingly, liquid that has spilled to the exterior of the liquid resupply unit is guided to the recess or the opening by the groove, and is collected within the housing through the opening. The liquid tank includes the liquid receiving part, and thus the liquid held within the housing is received through the opening. The risk of liquid leaking to the exterior of the housing can therefore be reduced.

In a liquid ejecting apparatus according to another aspect of the invention, preferably, the recess is longer in the X axis direction than in the Y axis direction.

According to this configuration, the recess is longer in the X axis direction than in the Y axis direction, and thus the outer dimension of the housing with respect to the Y axis direction can be reduced.

In a liquid ejecting apparatus according to another aspect of the invention, preferably, a nonplanar part that can engage with a resupply receptacle, the resupply receptacle holding the liquid that can be resupplied to the liquid tank, is provided in the recess.

According to this configuration, the nonplanar part is provided in the recess. Thus a resupply receptacle that can fit with the nonplanar part can be identified as holding a liquid that can be resupplied. The risk that the liquid tank will be resupplied with a different type of liquid can therefore be reduced.

In a liquid ejecting apparatus according to another aspect of the invention, preferably, the opening is provided in a position corresponding to the liquid resupply unit.

The liquid with which the liquid tank is resupplied easily spills in the vicinity of the liquid resupply unit. With respect to this point, according to this configuration, the opening is provided in a position corresponding to the liquid resupply unit, and thus spilled liquid can easily be guided from the opening to within the housing.

In a liquid ejecting apparatus according to another aspect of the invention, preferably, assuming that the covering part is taken as a first part, the housing includes a second part that covers the liquid tank in the +Y axis direction; and the opening is provided in a position between the liquid resupply unit and the second part with respect to the Y axis direction.

When resupplying the liquid tank with liquid from the +Y axis direction side, it is easy for the liquid to spill further toward the +Y axis direction side than the liquid resupply unit. With respect to this point, the opening is provided in a position between the liquid resupply unit and the second part with respect to the Y axis direction. Accordingly, the spilled liquid can easily be guided into the housing from the opening.

In a liquid ejecting apparatus according to another aspect of the invention, preferably, the covering part includes an inclined part inclined in the −Z axis direction toward the recess or the opening.

According to this configuration, the covering part includes the inclined part, and thus the liquid can be guided toward the recess or the opening.

In a liquid ejecting apparatus according to another aspect of the invention, preferably, the groove is provided in the inclined part.

According to this configuration, the groove is provided in the inclined part, and thus the liquid can be efficiently guided toward the recess or the opening.

In a liquid ejecting apparatus according to another aspect of the invention, preferably, the opening is provided in a position corresponding to the liquid receiving part.

According to this configuration, the opening is provided in a position corresponding to the liquid receiving part. Accordingly, the risk of liquid held within the housing leaking to the exterior of the housing through the opening can be reduced.

In a liquid ejecting apparatus according to another aspect of the invention, preferably, the liquid receiving part includes an absorption member that absorbs the spilled liquid.

According to this configuration, the liquid receiving part includes the absorption member, and thus liquid that has exited the opening can be absorbed by the absorption member. The risk of liquid leaking to the exterior of the housing can therefore be reduced.

In a liquid ejecting apparatus according to another aspect of the invention, preferably, the opening at least partially contacts the absorption member.

According to this configuration, the opening contacts the absorption member, and thus liquid that has exited the opening can be absorbed by the absorption member more easily than in a case where the absorption member is provided separated from the opening.

In a liquid ejecting apparatus according to another aspect of the invention, preferably, at least one slit is provided in the absorption member; and the liquid receiving part further includes at least one projection, the projection corresponding to the slit and projecting in the +Z axis direction.

According to this configuration, the absorption member can be positioned by aligning the projection provided in the liquid receiving part with the slit provided in the absorption member. There is thus less of a risk of the absorption member shifting, even if the liquid tank moves along with the carriage.

According to another aspect of the invention, preferably, the liquid ejecting apparatus further includes: a liquid ejecting head that ejects the liquid; and a circuit board that can be electrically connected to the liquid ejecting head through a connector provided in the carriage, wherein the liquid resupply unit, the recess, and the opening are disposed further on the +Y axis direction side than the connector.

When resupplying the liquid tank with liquid from the +Y axis direction side, it is easy for the liquid to spill in the areas surrounding the liquid resupply unit and further toward the +Y axis direction side than the liquid resupply unit. With respect to this point, according to this configuration, the liquid resupply unit, the recess, and the opening are disposed further toward the +Y axis direction side than the connector, which makes it possible to reduce the risk of spilled liquid landing on the connector.

In a liquid ejecting apparatus according to another aspect of the invention, preferably, a projecting wall is provided in the covering part, the projecting wall being located at least partially between the liquid resupply unit and the connector with respect to the Y axis direction, and the projecting wall projecting in the +Z axis direction.

According to this configuration, the projecting wall is provided between the liquid resupply unit and the connector, and thus the risk that liquid that has spilled to the surrounding areas of the liquid resupply unit will flow toward the connector can be reduced. This makes it possible to reduce the risk that liquid will land on the connector.

A liquid ejecting apparatus according to another aspect of the invention is a liquid ejecting apparatus, wherein assuming three spatial axes orthogonal to one another are an X axis, a Y axis, and a Z axis, directions following the X axis, the Y axis, and the Z axis are an X axis direction, a Y axis direction, and a Z axis direction, respectively, positive directions following the X axis, the Y axis, and the Z axis are a +X axis direction, a +Y axis direction, and a +Z axis direction, respectively, negative directions following the X axis, the Y axis, and the Z axis are a −X axis direction, a −Y axis direction, and a −Z axis direction, respectively, and the vertical direction is the −Z axis direction, the liquid ejecting apparatus comprises: a liquid tank, the liquid tank being mounted in a carriage configured to move back and forth in the X axis direction, and the liquid tank including a liquid resupply unit configured to accept resupply of a liquid from the exterior, wherein the liquid tank includes a recess, the recess being provided in a resupply unit formation wall in which the liquid resupply unit is provided, and the recess being recessed in the −Z axis direction, in order to receive a spilled liquid that has spilled to the exterior of the liquid resupply unit; and the liquid resupply unit is provided in the recess.

According to this configuration, the liquid tank includes the recess provided in the resupply unit formation wall, and the liquid resupply unit is provided in the recess. Accordingly, liquid that has spilled to the exterior of the liquid resupply unit can be taken into the recess. Situations where the surrounding areas are soiled by the spilled liquid can therefore be reduced.

In a liquid ejecting apparatus according to another aspect of the invention, preferably, the recess is longer in the X axis direction than in the Y axis direction.

According to this configuration, the recess is longer in the X axis direction than in the Y axis direction, and thus the outer dimension of the liquid tank with respect to the Y axis direction can be reduced.

In a liquid ejecting apparatus according to another aspect of the invention, preferably, a nonplanar part that can engage with a resupply receptacle, the resupply receptacle holding the liquid that can be resupplied to the liquid tank, is provided in the recess.

According to this configuration, the same effects as those of the aforementioned liquid ejecting apparatus can be achieved.

In a liquid ejecting apparatus according to another aspect of the invention, preferably, an absorption member that absorbs the liquid is provided in the recess.

According to this configuration, the absorption member is provided in the recess, and thus liquid that has been received by the recess can be absorbed by the absorption member. The risk of liquid leaking to the exterior of the recess can therefore be reduced.

According to another aspect of the invention, preferably, the liquid ejecting apparatus further includes: a liquid ejecting head that ejects the liquid; and a circuit board that can be electrically connected to the liquid ejecting head through a connector provided in the carriage, wherein the liquid resupply unit and the recess are disposed further on the +Y axis direction side than the connector.

According to this configuration, the same effects as those of the aforementioned liquid ejecting apparatus can be achieved.

In a liquid ejecting apparatus according to another aspect of the invention, preferably, a projecting wall is provided in the resupply unit formation wall, the projecting wall being located at least partially between the liquid resupply unit and the connector with respect to the Y axis direction, and the projecting wall projecting in the +Z axis direction.

According to this configuration, the same effects as those of the aforementioned liquid ejecting apparatus can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
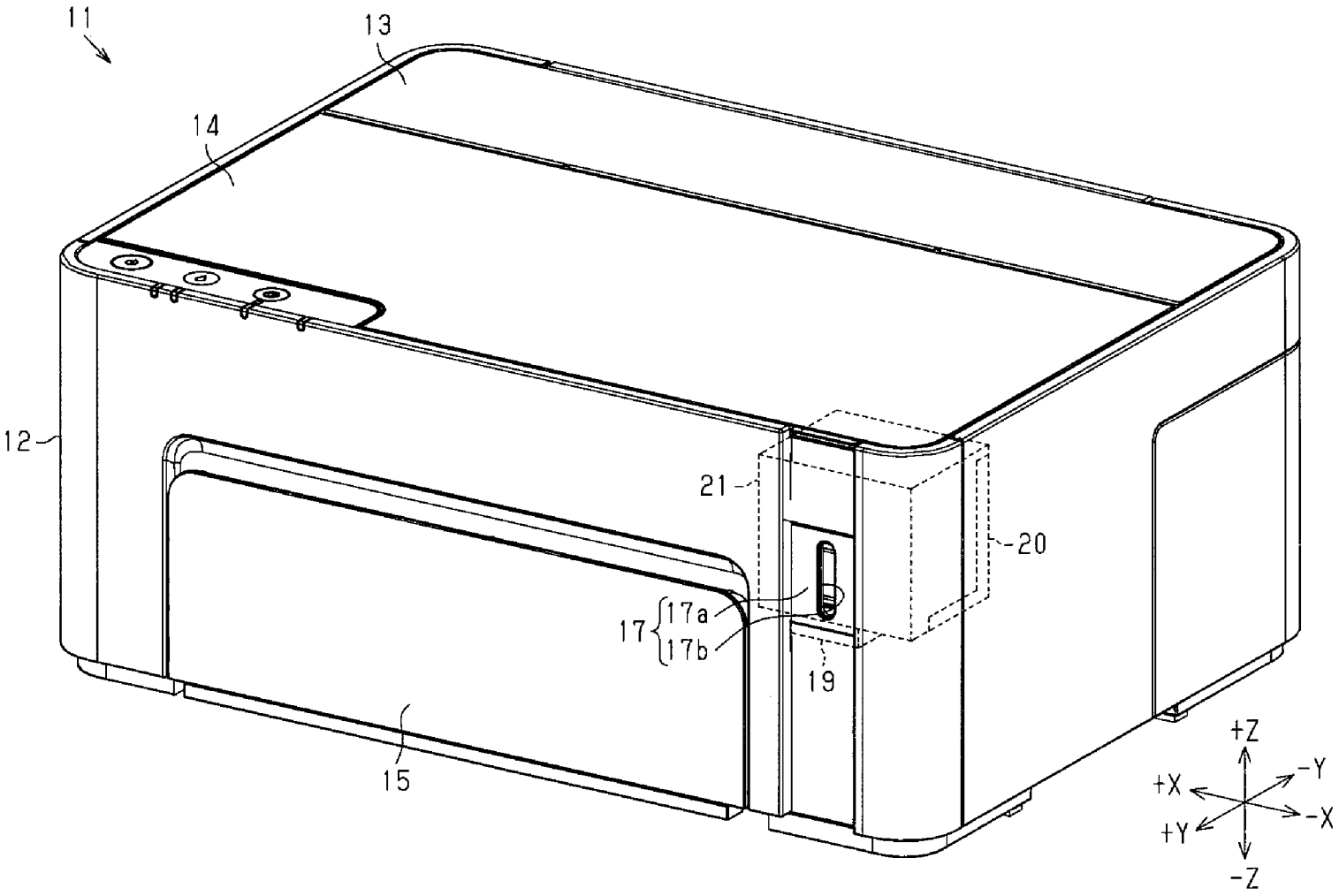
FIG. 1 is a perspective view illustrating one embodiment of a liquid ejecting apparatus.

An embodiment of a liquid ejecting apparatus will be described hereinafter with reference to the drawings. The liquid ejecting apparatus is, for example, an ink jet printer that records (prints) by ejecting a liquid such as ink onto a medium such as paper.

In the following descriptions, three spatial axes that are orthogonal to one another will be referred to as an X axis, a Y axis, and a Z axis, respectively, and directions following the X axis, the Y axis, and the Z axis will be referred to as an X axis direction, a Y axis direction, and a Z axis direction, respectively. In the drawings, positive directions following the X axis, the Y axis, and the Z axis are indicated as a +X axis direction, a +Y axis direction, and a +Z axis direction, respectively, whereas negative directions following the X axis, the Y axis, and the Z axis are indicated as a −X axis direction, a −Y axis direction, and a −Z axis direction, respectively.

FIG. 1 illustrates a state where a liquid ejecting apparatus 11 is placed on a horizontal plane, with the vertical direction corresponding to the −Z axis direction, and directions following the horizontal plane, which is orthogonal to the vertical direction, corresponding to the X axis direction and the Y axis direction. In this embodiment, the X axis direction corresponds to width, the Y axis direction corresponds to depth, and the Z axis direction corresponds to height. In the following descriptions, the +Y axis direction may be referred to as a front side; the −Y axis direction, as a rear side; the +Z axis direction, as an upper side; the −Z axis direction, as a lower side; the +X axis direction, as a left side, when viewed from the front side; and the −X axis direction, as a right side, when viewed from the front side.

As illustrated in FIG. 1, the liquid ejecting apparatus 11 includes a substantially parallelepiped housing 12. A feed cover 13, which is located on the rear side, and a maintenance cover 14, which is located on the front side, are provided in an upper surface of the housing 12, in an openable/closable state. A discharge cover 15 is provided in a front surface of the housing 12, in an openable/closable state.

The liquid ejecting apparatus 11 includes an outer window 17, which is provided in the front surface of the housing 12. The outer window 17 includes a transmissive part 17*a*, which is constituted by a transparent or semitransparent member and transmits light, and a rectangular hole-shaped open part 17*b*, which is formed so as to pass through the transmissive part 17*a*.

The liquid ejecting apparatus 11 includes: a liquid ejecting head 19 that ejects a liquid; a carriage 20 that holds the liquid ejecting head 19; and a liquid holding unit 21 configured to supply the liquid to the liquid ejecting head 19.

Figure 2:
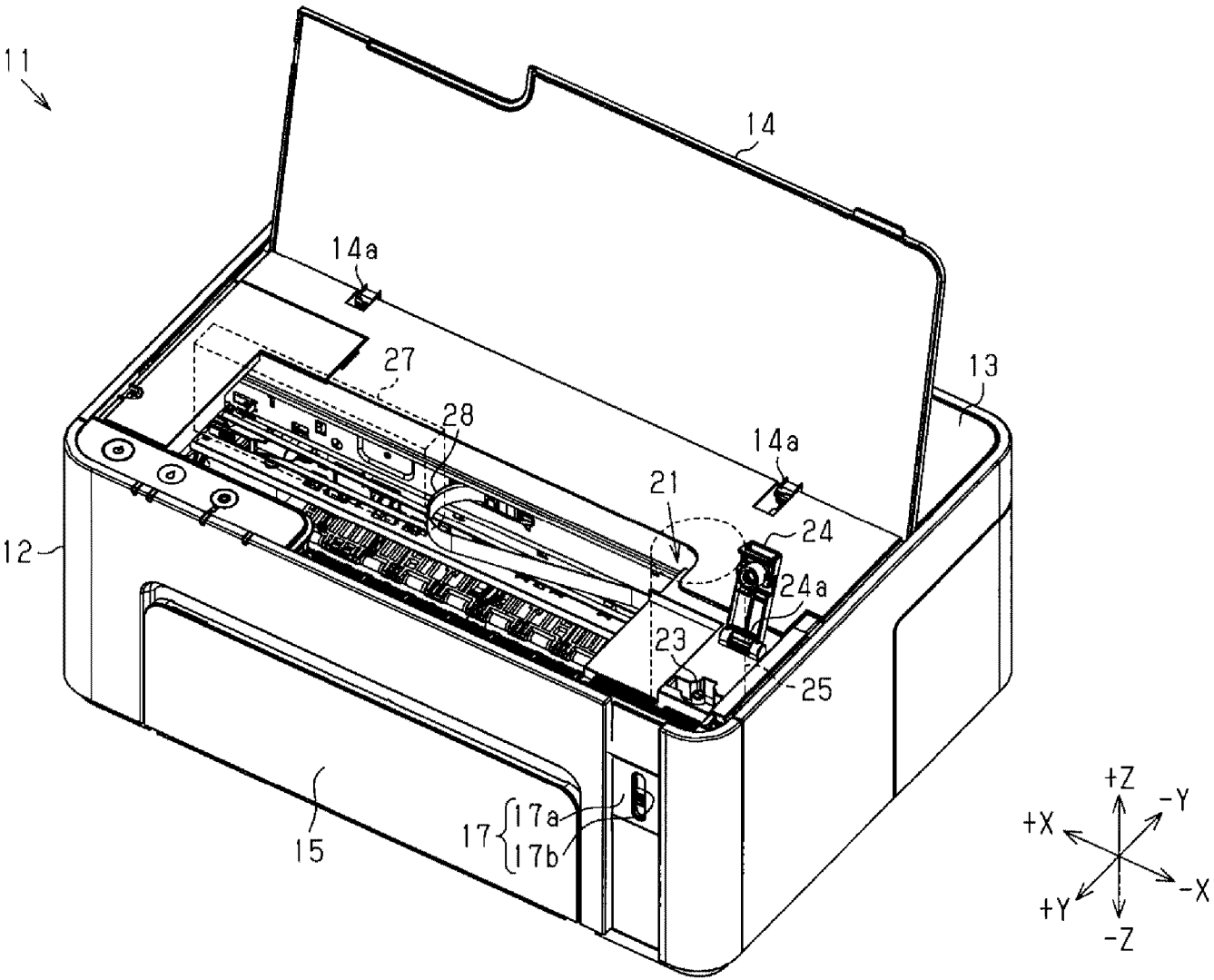
FIG. 2 is a perspective view illustrating a liquid ejecting apparatus to which a liquid is resupplied.

As illustrated in FIG. 2, the maintenance cover 14 pivots central to a first shaft 14*a* provided on a rear end side. The maintenance cover 14 can be placed in a closed position (see FIG. 1), or in an open position (see FIG. 2) by swinging a front end upward from the closed position.

The liquid holding unit 21 includes a liquid resupply unit 23 for receiving liquid resupply from the exterior, and a cover 24 that covers the liquid resupply unit 23. When the maintenance cover 14 is positioned in the open position, the liquid holding unit 21 is exposed and the cover 24 can be opened/closed. The cover 24 pivots central to a second shaft 24*a* provided on the rear end. The cover 24 can be placed in a closed position (see FIG. 4), or in an open position (see FIG. 2) by swinging a front end upward from the closed position.

The liquid resupply unit 23 is positioned further to the front side than the first shaft 14*a* and the second shaft 24*a* with respect to the Y axis direction. As such, when the maintenance cover 14 and the cover 24 are positioned in the open position, the liquid resupply unit 23 is positioned further to the front side than the maintenance cover 14 and the cover 24. When resupplying the liquid holding unit 21 with liquid, the liquid resupply can be carried out more easily by a user connecting a resupply receptacle 25, which holds liquid for resupply, to the liquid resupply unit 23 from the front side of the liquid holding unit 21.

The liquid holding unit 21 can be connected to the resupply receptacle 25 while positioned in a resupply position, which is a position on the rear side of the outer window 17. The user can therefore resupply the liquid holding unit 21 with the liquid while viewing the liquid holding unit 21 through the outer window 17.

The liquid ejecting apparatus 11 includes a circuit board 27 that comprehensively controls the driving of the various mechanisms in the liquid ejecting apparatus 11, such as the liquid ejecting head 19. The circuit board 27 and the liquid ejecting head 19 are electrically connected by a flexible cable 28.

Figure 3:
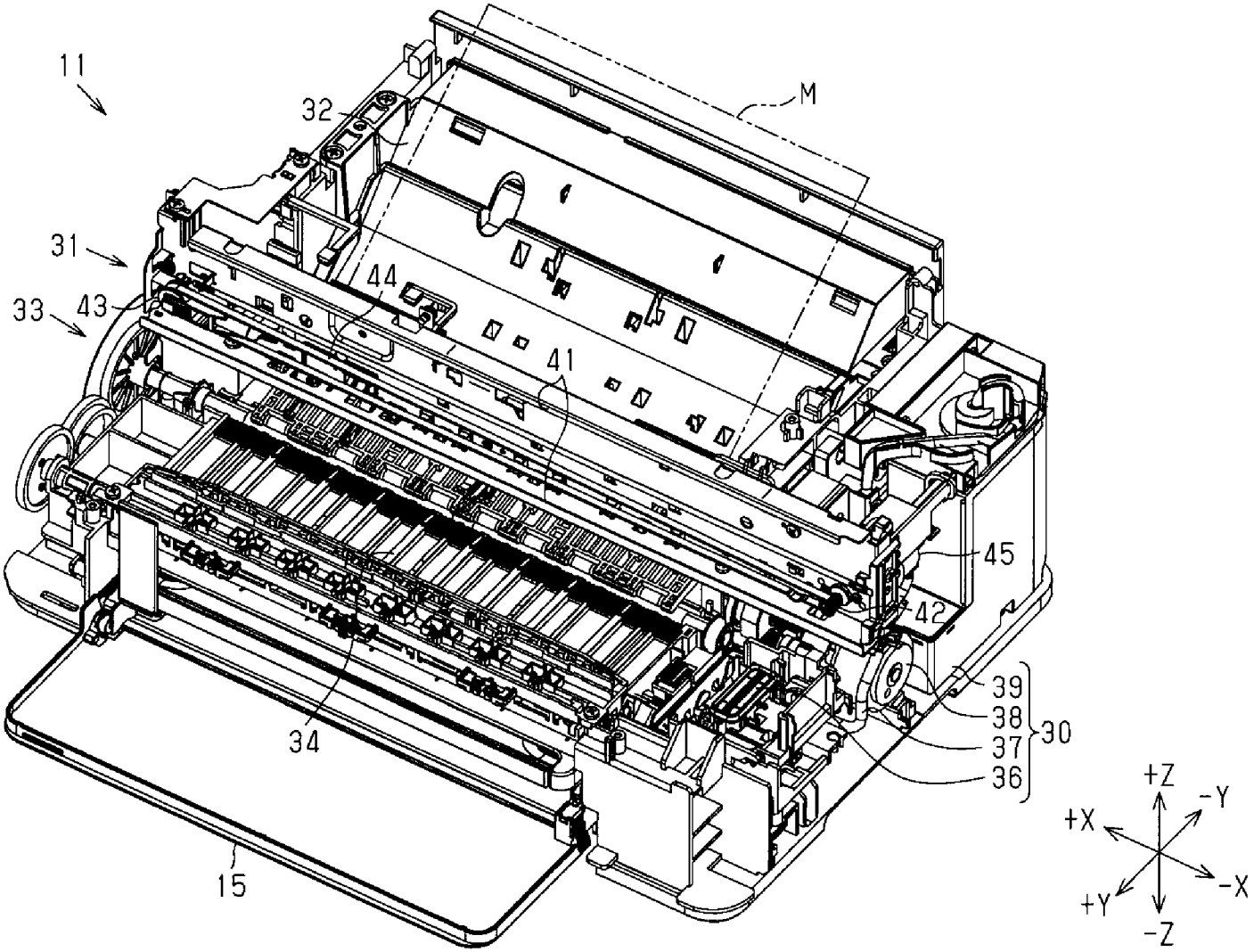
FIG. 3 is a perspective view illustrating the internal configuration of a liquid ejecting apparatus.

As illustrated in FIG. 3, the liquid ejecting apparatus 11 includes a maintenance mechanism 30 for carrying out maintenance on the liquid ejecting head 19, and a movement mechanism 31 that moves the carriage 20. The liquid ejecting apparatus 11 includes a placement unit 32 on which a medium M is placed before printing, a transport mechanism 33 that transports the medium M placed on the placement unit 32, and a support platform 34 that supports the transported medium M.

The maintenance mechanism 30 includes a suction cap 36 provided so as to be movable relative to the liquid ejecting head 19, and a discharge tube 37, with an upstream end of the discharge tube 37 being connected to the suction cap 36. The maintenance mechanism 30 includes a suction pump 38 provided partway along the discharge tube 37, and a waste liquid holding unit 39 that holds waste liquid.

The maintenance mechanism 30 carries out suction cleaning by bringing the suction cap 36 into contact with the liquid ejecting head 19 to form a space and then depressurizing that space to cause liquid to be discharged from nozzles (not shown). The liquid discharged as a result of the suction cleaning is held in the waste liquid holding unit 39.

The movement mechanism 31 includes: guide rails 41 that extend in the X axis direction and form a pair in the Z axis direction; a driving pulley 42 located between the pair of guide rails 41; a slave pulley 43; a timing belt 44; and a carriage motor 45, an output shaft of which is connected to the driving pulley 42. The timing belt 44 is an annular belt stretched upon the driving pulley 42 and the slave pulley 43.

Figure 4:
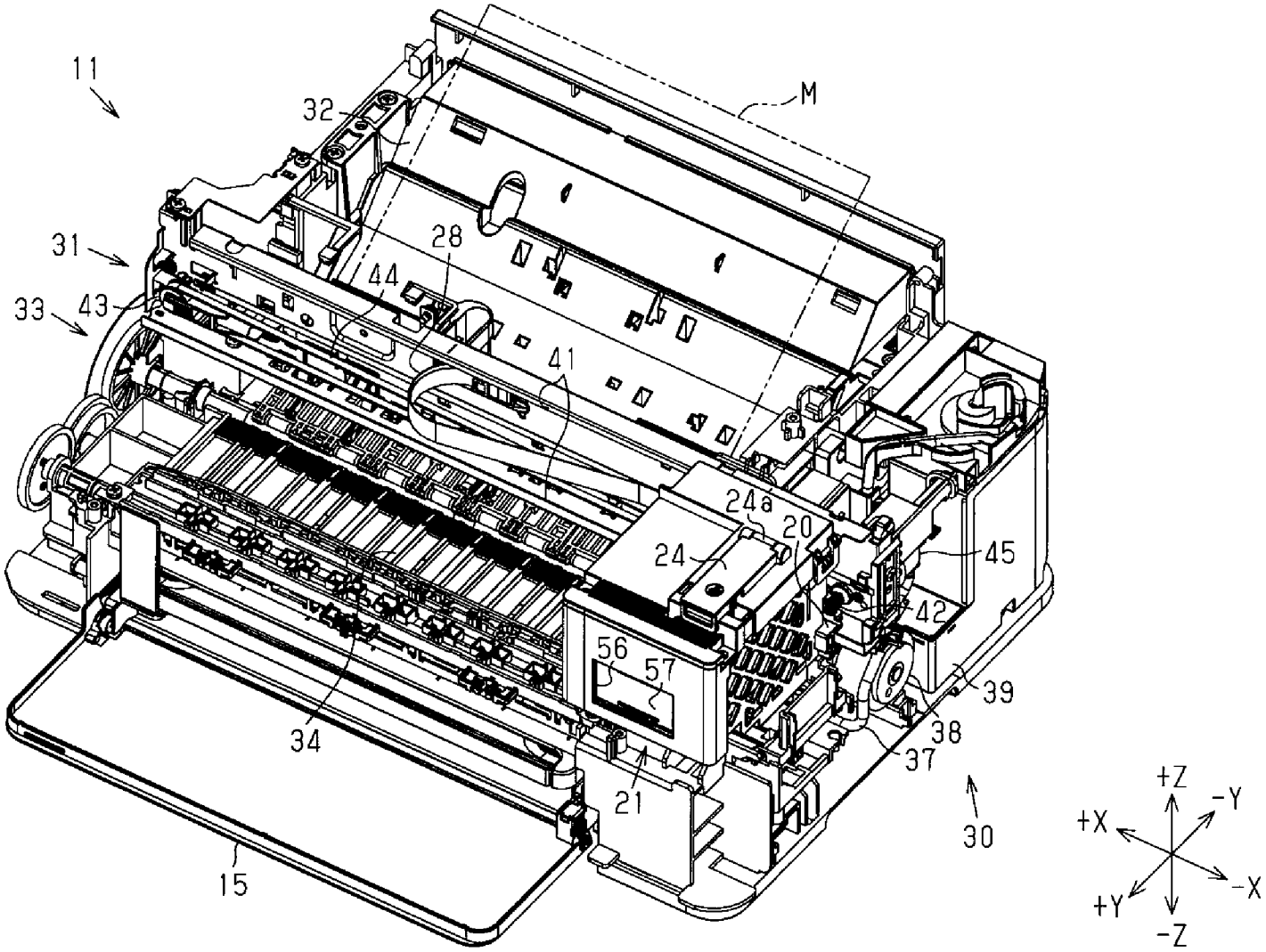
FIG. 4 is a perspective view illustrating the internal configuration of a liquid ejecting apparatus.

As illustrated in FIG. 4, the carriage 20 is supported by the guide rails 41 and is connected to the timing belt 44. When driving force from the carriage motor 45 is transmitted through the timing belt 44, the carriage 20 moves back and forth in the X axis direction (a main scanning direction) while being guided by the guide rails 41. The liquid ejecting head 19 and the liquid holding unit 21 are mounted in the carriage 20, and move back and forth in the X axis direction as the carriage 20 moves. The liquid ejecting apparatus 11 prints onto the medium M by ejecting the liquid, which is supplied from the liquid holding unit 21, from the nozzles (not shown) formed in the liquid ejecting head 19.

An embodiment of the liquid holding unit 21 will be described next.

Figure 5:
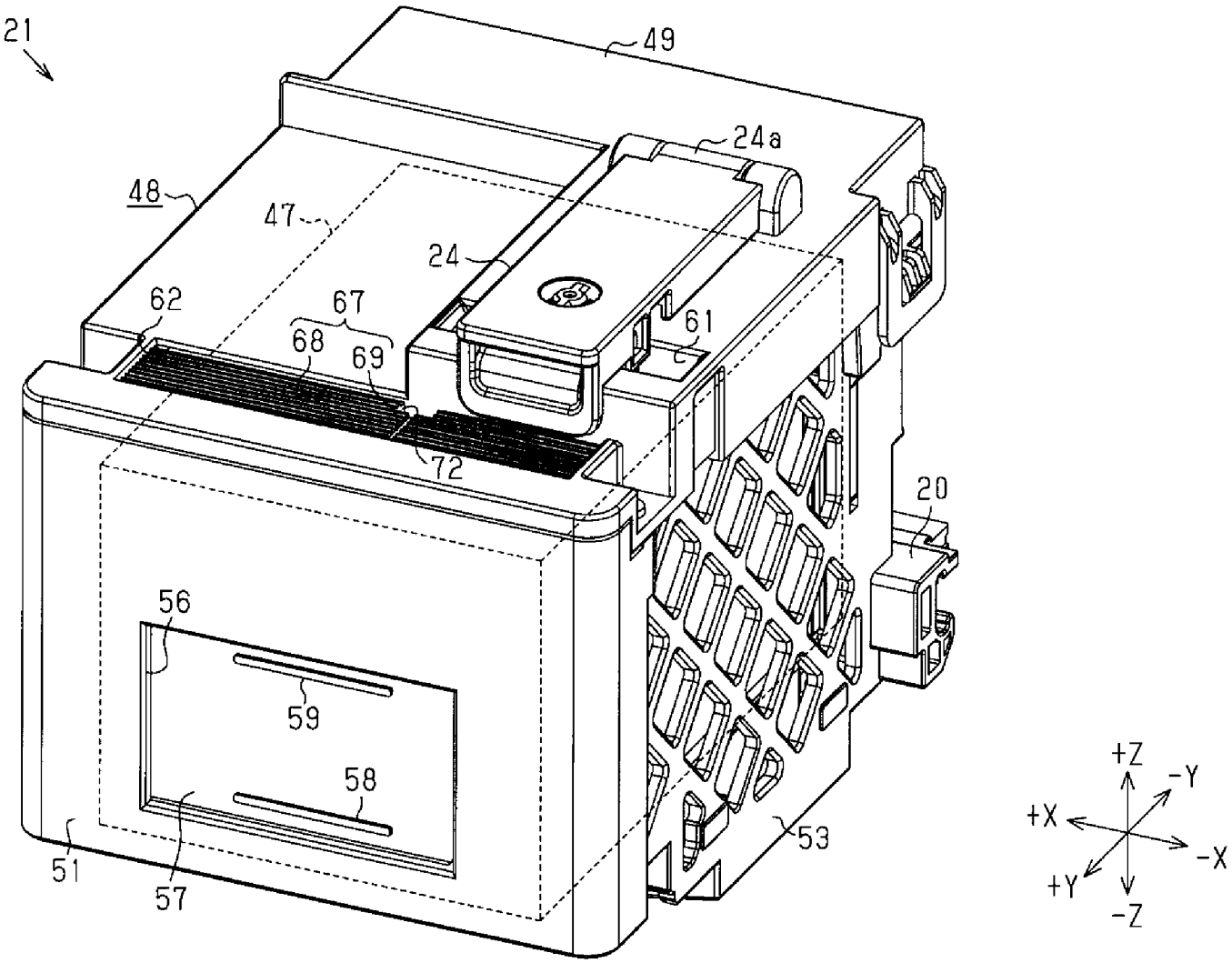
FIG. 5 is a perspective view illustrating an embodiment of a liquid holding unit.

As illustrated in FIG. 5, the liquid holding unit 21 includes a liquid tank 47 configured to hold the liquid, and a housing 48 configured to cover the liquid tank 47. The housing 48 is substantially a parallelepiped, and includes: an upper wall 49, which is an example of a covering part and a first part; a lower wall 50 (see FIG. 7); a front wall 51, which is an example of a second part; a rear wall 52 (see FIG. 7); a right wall 53; and a left wall 54 (see FIG. 7). The housing 48 may be at least partially configured integrally with the carriage 20.

The upper wall 49 at least partially covers the liquid tank 47 from the upper side (the +Z axis direction). The lower wall 50 at least partially covers the liquid tank 47 from the lower side. The front wall 51 at least partially covers the liquid tank 47 from the front side (the +Y axis direction). The rear wall 52 at least partially covers the liquid tank 47 from the rear side. The right wall 53 at least partially covers the liquid tank 47 from the right side. The left wall 54 at least partially covers the liquid tank 47 from the left side. In the housing 48, a plurality of walls among the upper wall 49, the lower wall 50, the front wall 51, the rear wall 52, the right wall 53, and the left wall 54 may be formed integrally. For example, the lower wall 50, the front wall 51, and the rear wall 52 may be formed integrally. Part of the lower wall 50 and the right wall 53 may be formed integrally.

A rectangular inner window 56 is formed in the front wall 51, and the liquid tank 47 is partially exposed from the inner window 56. The liquid tank 47 is made from a transparent or semitransparent resin, and the liquid surface level of the liquid held therein can be seen from the exterior. The exposed region of the liquid tank 47 corresponding to the inner window 56 functions as a viewing surface 57 through which the liquid surface level of the liquid can be viewed from the exterior of the liquid holding unit 21. The viewing surface 57 is provided with a lower limit display part 58 serving as an indicator for resupplying the liquid holding unit 21 with liquid, and an upper limit display part 59 serving as an indicator of an upper limit for the liquid resupply amount. When the liquid holding unit 21 is positioned in the resupply position, the lower limit display part 58, the upper limit display part 59, and the liquid surface level can be seen from the outer side of the housing 12 through the inner window 56 and the outer window 17 (see FIG. 2).

Figure 6:
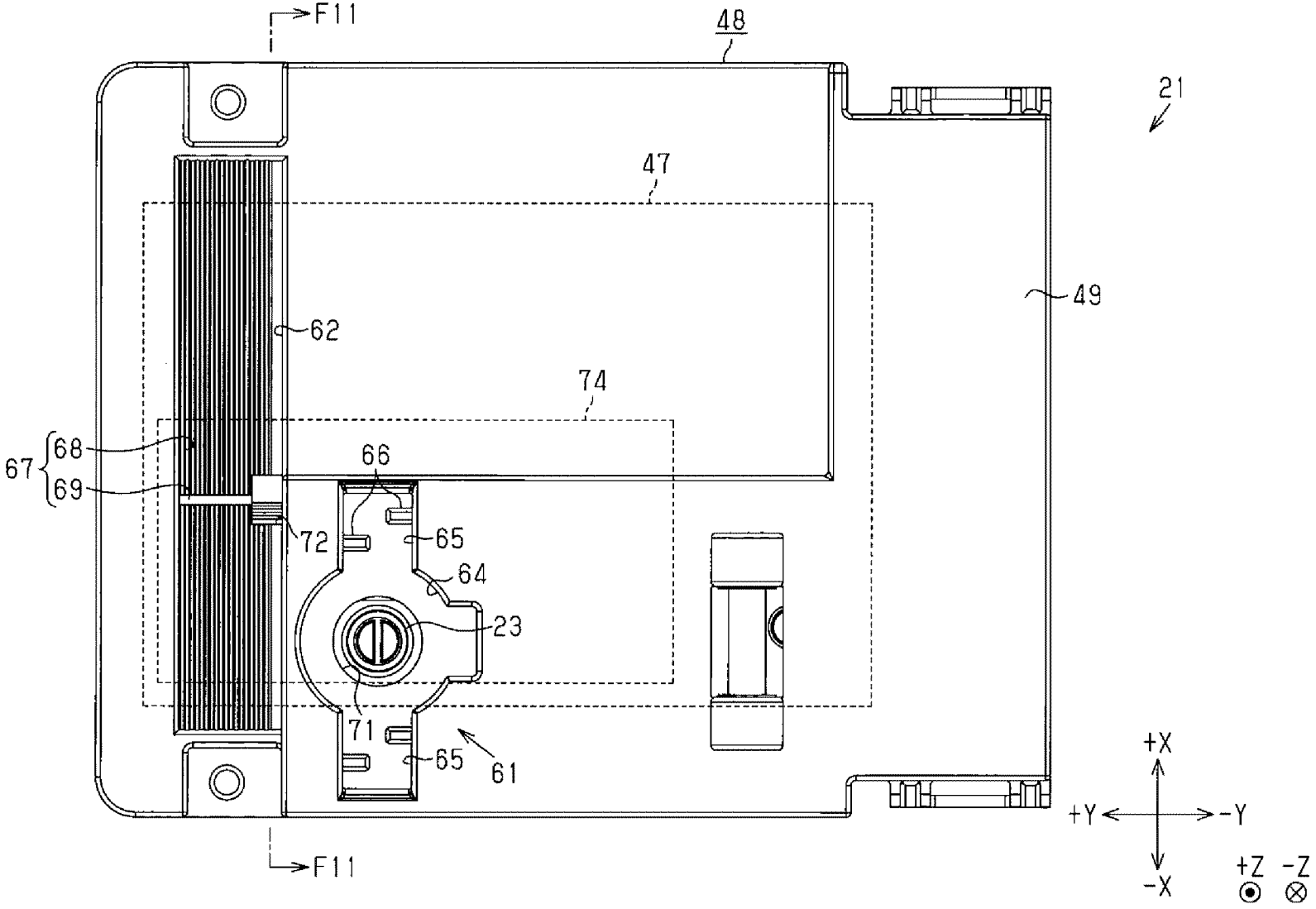
FIG. 6 is a plan view illustrating a liquid holding unit, without a cover illustrated.

As illustrated in FIG. 6, the housing 48 includes a first recess part 61 and a second recess part 62 provided in the upper wall 49. The second recess part 62 is located further toward the front side than the first recess part 61. The first recess part 61 and the second recess part 62 are recessed downward (the −Z axis direction) so as to accommodate liquid that has spilled to the exterior of the liquid resupply unit 23. The first recess part 61 and the second recess part 62 are longer in the X axis direction than in the Y axis direction.

The first recess part 61 includes a circular recess 64 having a substantially circular shape when viewed in plan view, and a pair of rectangular recesses 65 having substantially rectangular shapes when viewed in plan view. The pair of rectangular recesses 65 are provided on either side of the circular recess 64 with respect to the X axis direction, and communicate with the circular recess 64. A nonplanar part 66 that can fit with the resupply receptacle 25, which holds liquid that can be resupplied to the liquid tank 47 (see FIG. 2), may be provided in the first recess part 61. By providing the nonplanar part 66 in the first recess part 61, the resupply receptacle 25, which is shaped so as to be capable of fitting with the nonplanar part 66, can fit with the first recess part 61.

The housing 48 includes grooves 67 formed within the second recess part 62. In this embodiment, the grooves 67 include a plurality of lateral grooves 68 extending in the X axis direction and arranged in the Y axis direction, and a longitudinal groove 69 extending in the Y axis direction and intersecting with the lateral grooves 68. Preferably, the grooves 67 are formed at widths that produce a capillary phenomenon. The lateral grooves 68 are formed with a wavelike shape, and the lateral grooves 68 and the longitudinal groove 69 have substantially the same widths.

The housing 48 includes a first opening 71, which is provided in the first recess part 61 and is circular when viewed in plan view, for allowing liquid to pass downward (in the −Z axis direction). The first opening 71 is provided in a position corresponding to the liquid resupply unit 23. Specifically, the first opening 71 is located in the center of the circular recess 64 when viewed in plan view, and the positions of the first opening 71 and the liquid resupply unit 23 match with respect to the X axis direction and the Y axis direction. The inner diameter (diameter) of the first opening 71 is greater than the outer diameter (diameter) of the liquid resupply unit 23. The liquid resupply unit 23, which has a cylindrical shape, is inserted into the first opening 71.

The housing 48 includes a second opening 72, which is provided in the second recess part 62 and is rectangular when viewed in plan view, for allowing liquid to pass downward (in the −Z axis direction). The grooves 67 are provided oriented toward the second opening 72 so as to guide the liquid to the second opening 72. Of the grooves 67, the lateral grooves 68 communicate with the second opening 72 directly or via the longitudinal groove 69.

The liquid tank 47 includes the liquid resupply unit 23, and a liquid receiving part 74 for receiving the liquid. The first opening 71 and the second opening 72 are provided in positions corresponding to the liquid receiving part 74. Specifically, the first opening 71 and the second opening 72 are located directly above the liquid receiving part 74. Accordingly, liquid that has passed through the first opening 71 and the second opening 72 is received by the liquid receiving part 74.

Figure 7:
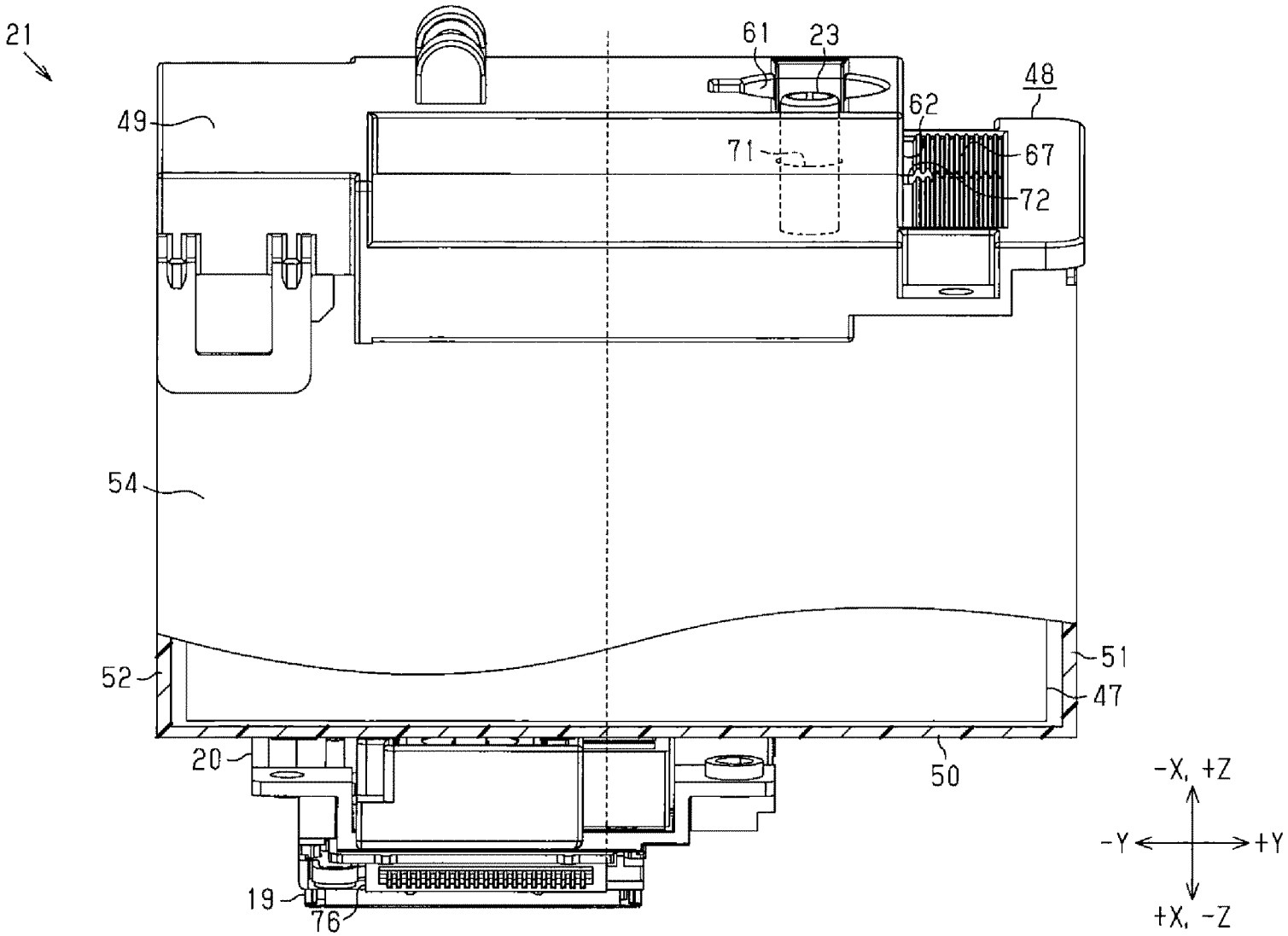
FIG. 7 is a partially cut-away schematic view of a liquid holding unit.

As illustrated in FIG. 7, the carriage 20 is provided with a connector 76 to which the cable 28 can be connected. Through the cable 28, the connector 76 electrically connects the circuit board 27 and the liquid ejecting head 19 provided in the liquid ejecting apparatus 11. In other words, the circuit board 27 can be electrically connected to the liquid ejecting head 19 through the connector 76.

The liquid resupply unit 23, the first recess part 61, the second recess part 62, the first opening 71, and the second opening 72 are disposed further toward the front side (the +Y axis direction side) than the connector 76, with respect to the Y axis direction. In other words, in the liquid holding unit 21, the connector 76, the first recess part 61 and the first opening 71, the second recess part 62 and the second opening 72, and the front wall 51 are positioned in that order in the Y axis direction, from the rear side. The grooves 67 and the second opening 72 are provided in positions between the liquid resupply unit 23 and the front wall 51 with respect to the Y axis direction.

An embodiment of the liquid tank 47 will be described next.

Figure 8:
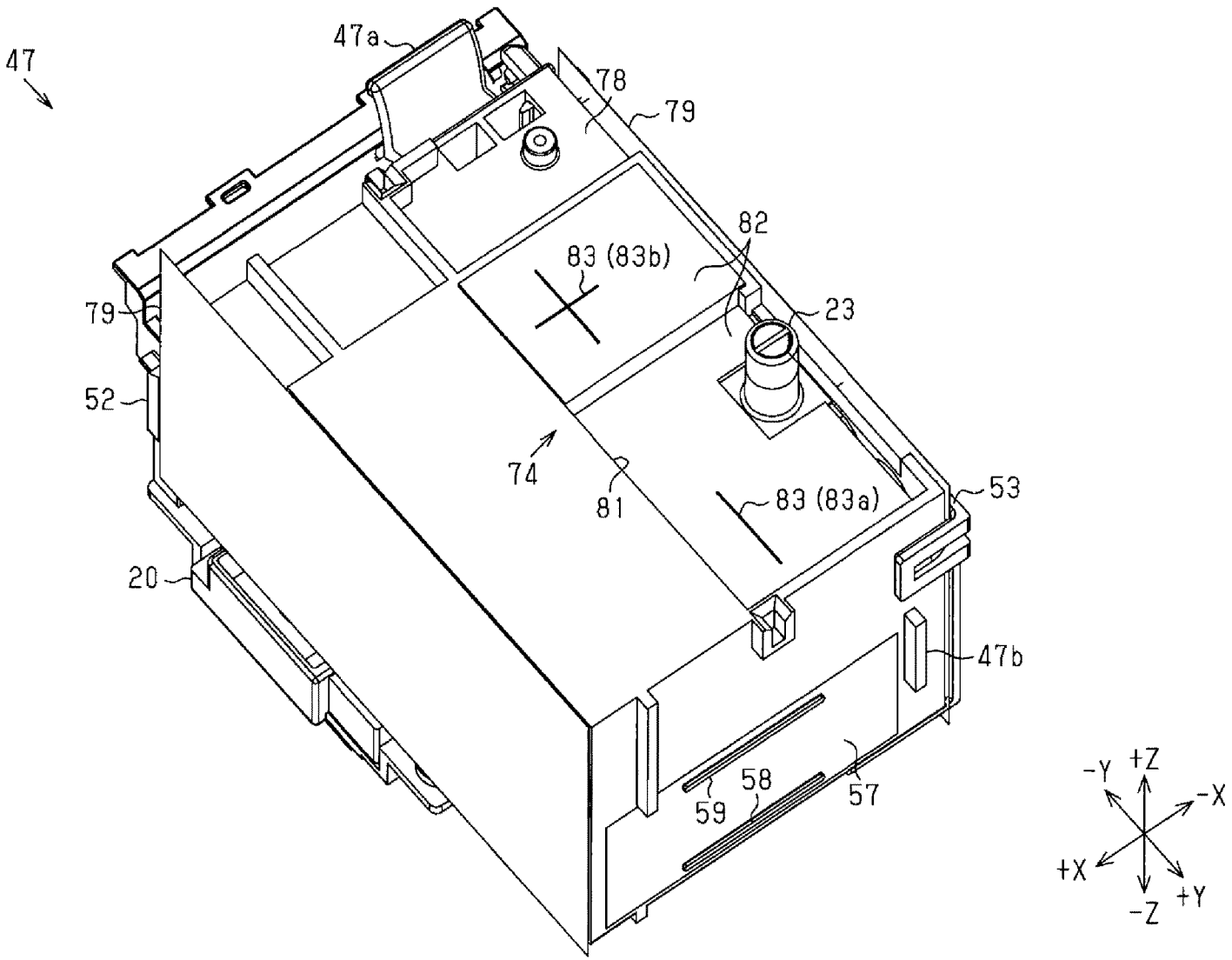
FIG. 8 is a perspective view illustrating an embodiment of a liquid tank.

As illustrated in FIG. 8, the liquid tank 47 includes: a main tank unit 78 having an opening in at least one surface thereof (both surfaces with respect to the X axis direction, in this embodiment); and at least one sheet (two sheets, in this embodiment) of a film 79 that covers the opening in the main tank unit 78. The liquid tank 47 also includes: a locking part 47*a*, having a lever shape, for locking the liquid tank 47 with the carriage 20; and at least one positioning part 47*b*, having a rib shape, for positioning the liquid tank 47 with respect to the carriage 20 or the housing 48. Preferably, the locking part 47*a* and the positioning part 47*b* are provided in different surfaces of the liquid tank 47 with respect to the Y axis direction (e.g., a rear surface and a front surface).

The liquid receiving part 74 is provided in at least part of an upper surface of the liquid tank 47 (in the +Z axis direction). The liquid receiving part 74 includes a liquid receiving recess 81, which is recessed downward (in the −Z axis direction) and is substantially rectangular when viewed in plan view, and an absorption member 82 for absorbing liquid. The liquid receiving part 74 may include a plurality of board-shaped absorption members 82.

Figure 9:
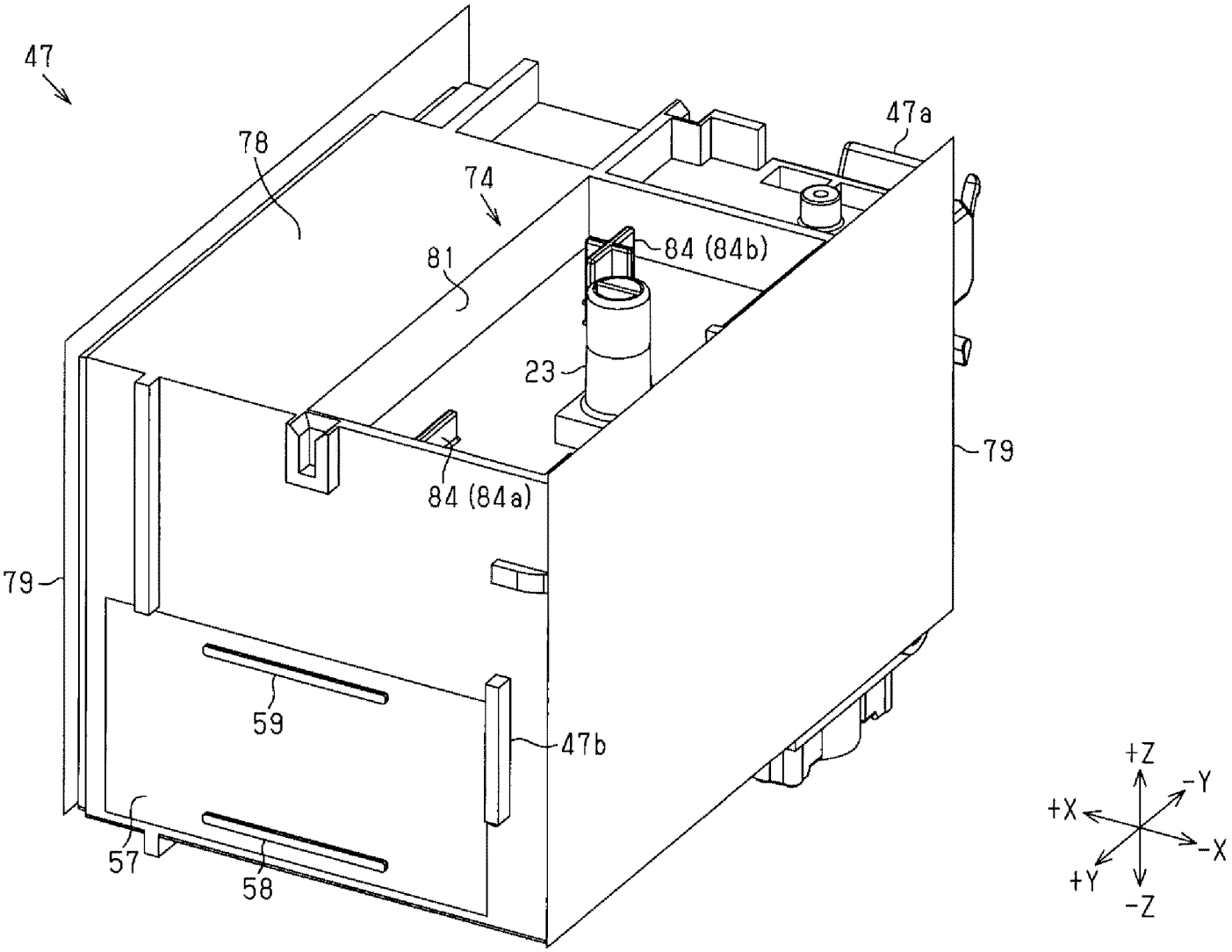
FIG. 9 is a perspective view of a liquid tank from which an absorption member has been removed.
Figure 10:
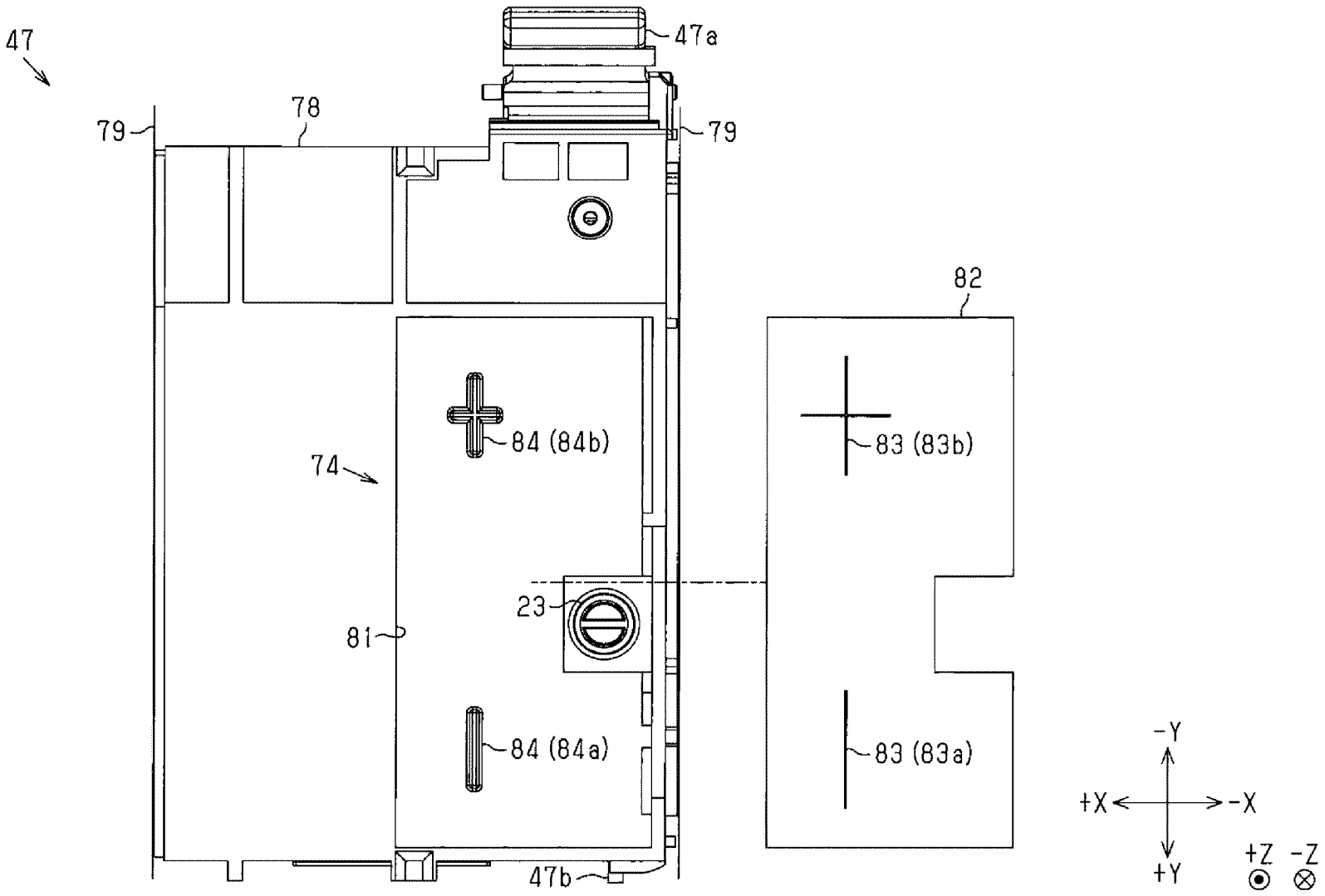
FIG. 10 is an exploded plan view of a liquid tank.

As illustrated in FIGS. 9 and 10, at least one (two, in this embodiment) slit 83 is provided in the absorption member 82. The liquid receiving part 74 includes at least one (two, in this embodiment) projection 84 projecting upward (the +Z axis direction), in a position corresponding to the slit 83. The projection 84 is provided in the liquid receiving recess 81. When a plurality of the projections 84 are provided, giving the projections 84 different shapes from each other makes it possible to position the absorption member 82 with respect to a plurality of axial directions.

The liquid receiving recess 81 according to this embodiment is provided with: a first projection 84*a*, which has a minus-sign shape when viewed in plan view and extends in the Y axis direction; and a second projection 84*b*, which is located further toward the rear side than the first projection 84*a*, and has a plus-sign shape when viewed in plan view that extends in the X axis direction and the Y axis direction. A first slit 83*a*, which has a minus-sign shape when viewed in plan view and into which the first projection 84*a* is inserted, and a second slit 83*b*, which has a plus-sign shape when viewed in plan view and into which the second projection 84*b* is inserted, are formed in the absorption member 82.

Figure 11:
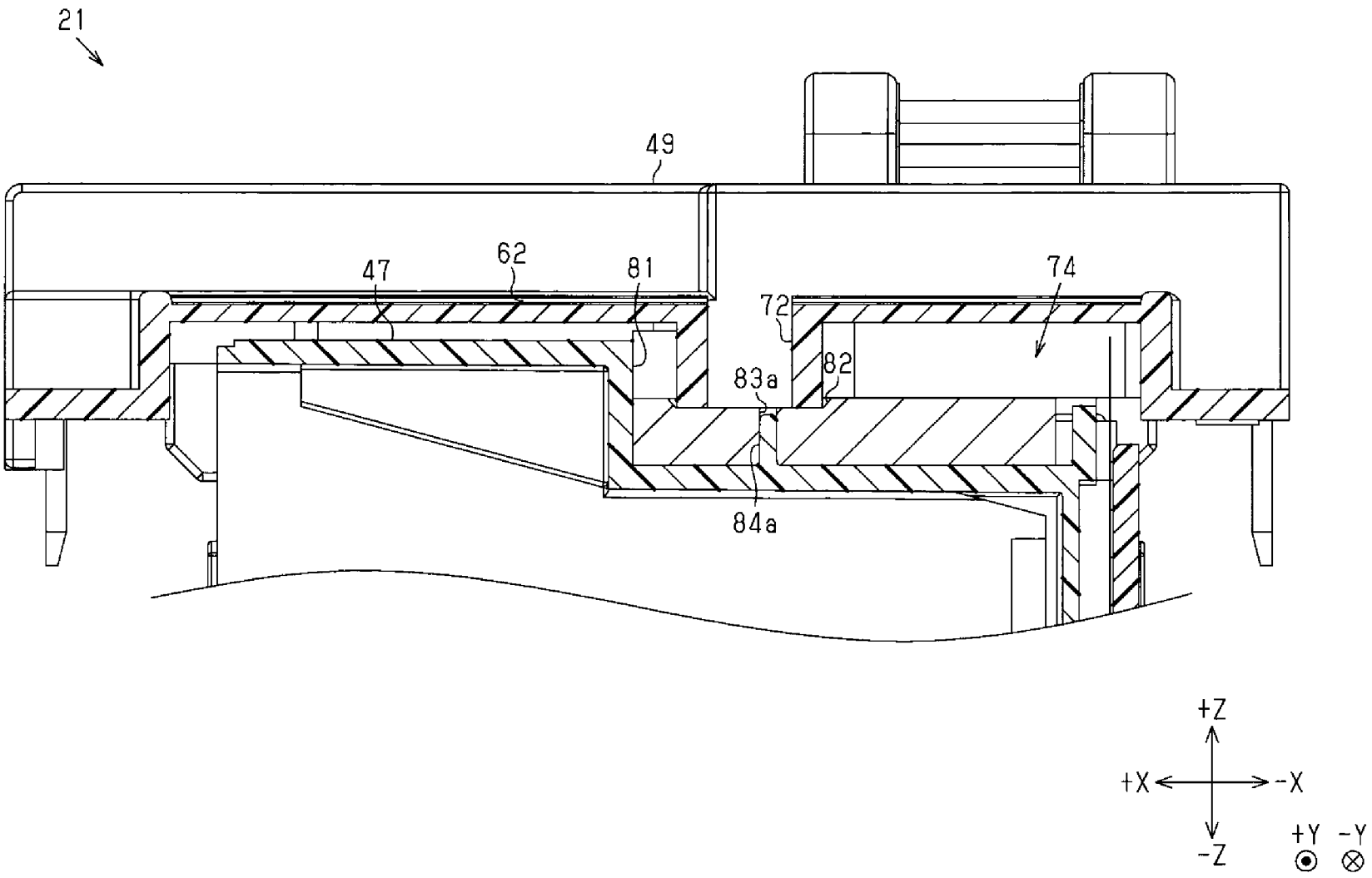
FIG. 11 is a cross-sectional view taken from a line F11-F11 indicated in FIG. 6.

As illustrated in FIG. 11, at least part of the second opening 72 contacts the absorption member 82. The second opening 72 is provided so that a lower end thereof contacts the absorption member 82 and compresses the absorption member 82.

Actions of the liquid holding unit 21 will be described next.

When the liquid holding unit 21 is resupplied with liquid, the liquid sometimes spills from the resupply receptacle 25. The liquid that has spilled to the surrounding areas of the liquid resupply unit 23 lands on the first recess part 61, and enters into the housing 48 through the first opening 71 formed in the first recess part 61.

If the resupply receptacle 25 is brought toward the liquid holding unit 21 from the front side of the liquid holding unit 21, it is easy for liquid that has spilled from the resupply receptacle 25 to land on areas further toward the front side than the liquid resupply unit 23. Liquid that has spilled further toward the front side than the liquid resupply unit 23 lands on the second recess part 62, and is led to the second opening 72 by the grooves 67.

The liquid is taken into the housing 48 through the first opening 71 and the second opening 72. The liquid that has passed through the first opening 71 and the second opening 72 is received by the liquid receiving part 74 located directly below the first opening 71 and the second opening 72. Thus even if the liquid holding unit 21 moves along with the carriage 20, the risk that liquid will scatter to the exterior of the housing 48 is reduced.

According to the embodiment described thus far, the following effects can be achieved.

(1) The housing 48 includes the first recess part 61 and the second recess part 62 provided in the upper wall 49. Accordingly, liquid that has spilled to the exterior of the liquid resupply unit 23 can be taken into the first recess part 61, the second recess part 62, and so on. Situations where the surrounding areas are soiled by the spilled liquid can therefore be reduced.

(2) The housing 48 includes the second opening 72, which is provided in the second recess part 62, and the grooves 67, which are provided oriented toward the second opening 72. Accordingly, liquid that has spilled to the exterior of the liquid resupply unit 23 is guided to the second opening 72 by the grooves 67, and is collected within the housing 48 through the second opening 72. The liquid tank 47 includes the liquid receiving part 74, and thus the liquid held within the housing 48 is received through the second opening 72. The risk of liquid leaking to the exterior of the housing 48 can therefore be reduced.

(3) The first recess part 61 is longer in the X axis direction than in the Y axis direction, and thus the outer dimension of the housing 48 with respect to the Y axis direction can be reduced.

(4) The nonplanar part 66 is provided in the first recess part 61. Thus the resupply receptacle 25 that can fit with the nonplanar part 66 can be identified as holding a liquid that can be resupplied. The risk that the liquid tank 47 will be resupplied with a different type of liquid can therefore be reduced.

(5) The liquid with which the liquid tank 47 is resupplied easily spills in the vicinity of the liquid resupply unit 23. With respect to this point, the first opening 71 is provided in a position corresponding to the liquid resupply unit 23, and thus spilled liquid can easily be guided from the first opening 71 to within the housing 48.

(6) When resupplying the liquid tank 47 with liquid from the front side, it is easy for the liquid to spill further toward the front side than the liquid resupply unit 23. With respect to this point, the second opening 72 is provided in a position between the liquid resupply unit 23 and the front wall 51 with respect to the Y axis direction. Accordingly, spilled liquid can be easily guided from the second opening 72 to within the housing 48.

(7) The first opening 71 and the second opening 72 are provided in positions corresponding to the liquid receiving part 74. Accordingly, the risk of liquid held within the housing 48 leaking to the exterior of the housing 48 through the first opening 71 and the second opening 72 can be reduced.

(8) The liquid receiving part 74 includes the absorption member 82, and thus liquid that has exited the first opening 71 and the second opening 72 can be absorbed by the absorption member 82. The risk of liquid leaking to the exterior of the housing 48 can therefore be reduced.

(9) Because the second opening 72 and the absorption member 82 are in contact, liquid that has exited the second opening 72 can be absorbed by the absorption member 82 more easily than in a case where the absorption member 82 is provided separated from the second opening 72.

(10) The absorption member 82 can be positioned by aligning the projections 84 provided in the liquid receiving part 74 with the slits 83 provided in the absorption member 82. There is thus less of a risk of the absorption member 82 shifting, even if the liquid tank 47 moves along with the carriage 20.

(11) When resupplying the liquid tank 47 with liquid from the front side, it is easy for the liquid to spill in the areas surrounding the liquid resupply unit 23 and further toward the front side than the liquid resupply unit 23. With respect to this point, the liquid resupply unit 23, the first recess part 61, the second recess part 62, the first opening 71, and the second opening 72 are disposed further toward the front side than the connector 76, which makes it possible to reduce the risk of spilled liquid landing on the connector 76.

Note that the aforementioned embodiment may be modified as described in the following modified examples. The above-described embodiment and the following modified examples may be combined as desired. Additionally, configurations included in the following modified examples may be combined with each other as desired.

Figure 12:
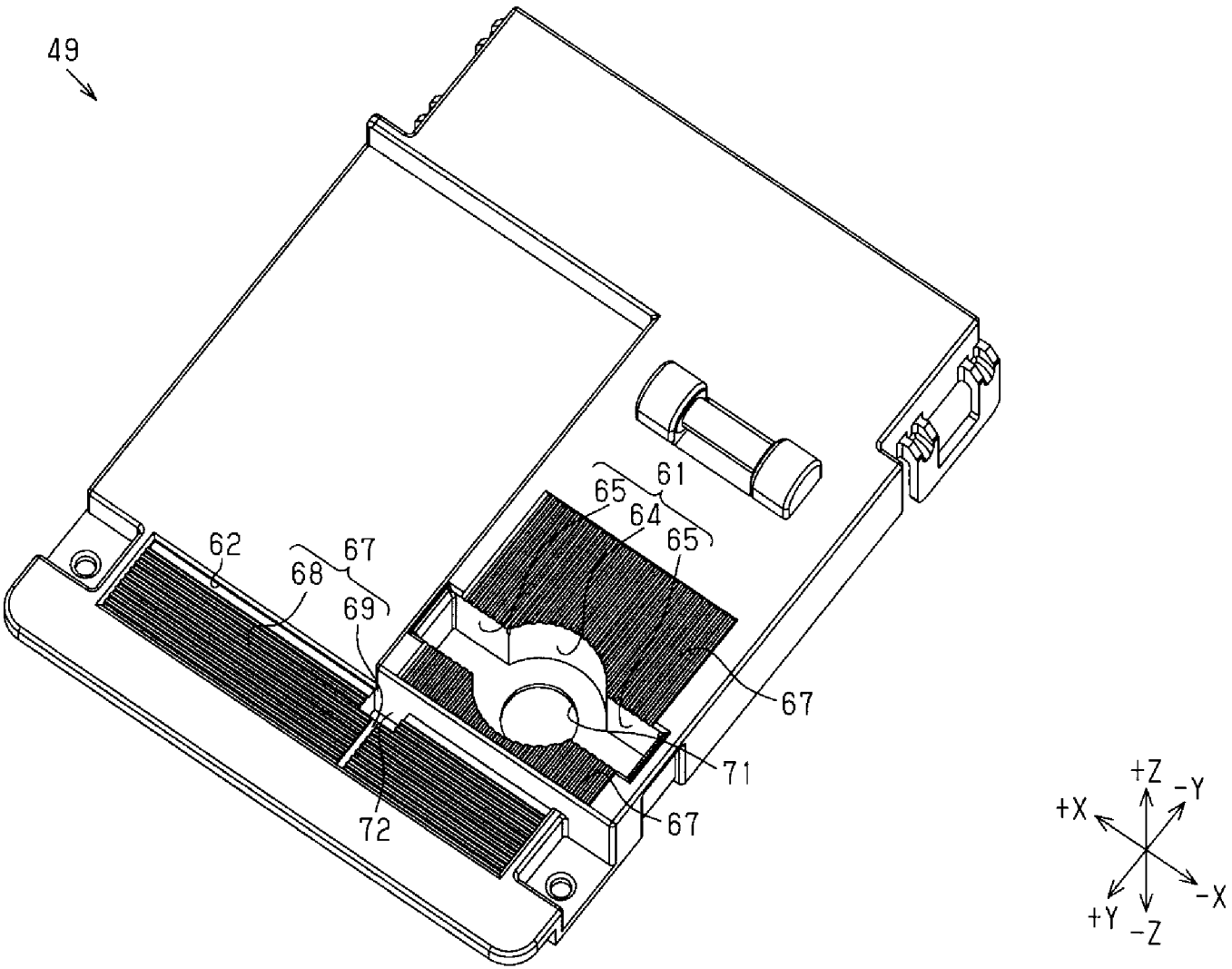
FIG. 12 is a perspective view illustrating a first modified example of an upper wall.

As illustrated in FIG. 12, the housing 48 may include grooves 67 provided oriented toward the first recess part 61 in order to guide the liquid toward the first opening 71 (a first modified example). In other words, the grooves 67 may be formed in the upper wall 49 so that one end of the grooves 67 connect to the first recess part 61 and the other ends are located in a different position from the first recess part 61. According to this configuration, liquid that has spilled to the exterior of the liquid resupply unit 23 is guided to the first recess part 61 by the grooves 67, and is collected within the housing 48 through the first opening 71. Situations where the surrounding areas are soiled by the spilled liquid can therefore be reduced.

Figure 13:
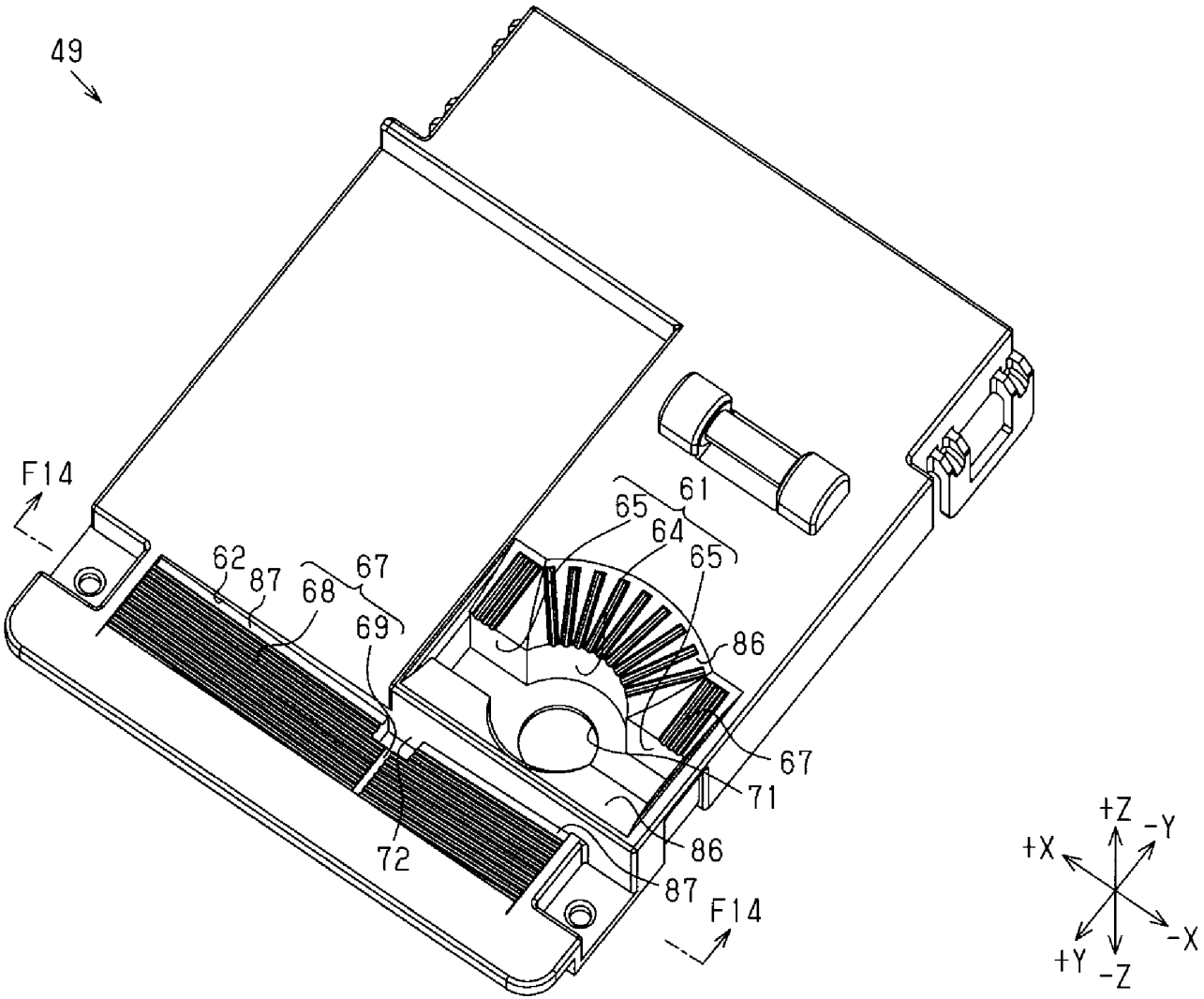
FIG. 13 is a perspective view illustrating a second modified example of an upper wall.
Figure 14:
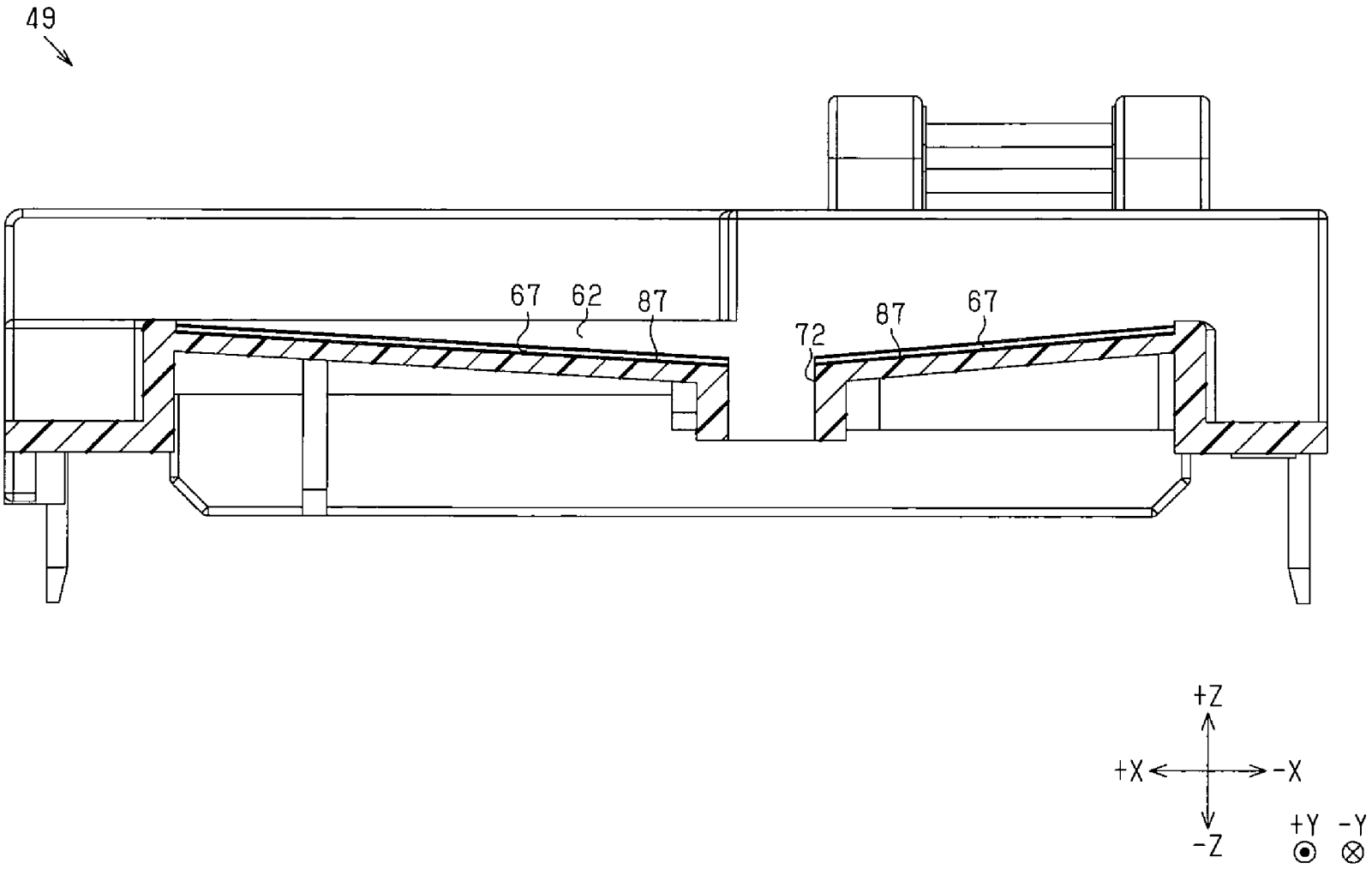
FIG. 14 is a cross-sectional view taken from a line F14-F14 indicated in FIG. 13.

As illustrated in FIGS. 13 and 14, the upper wall 49 may include an inclined part inclined downward (the −Z axis direction) toward at least one of the first recess part 61, the second recess part 62, the first opening 71, and the second opening 72 (a second modified example). For example, the upper wall 49 may include a first inclined part 86 inclined downward toward the first recess part 61. If the upper wall 49 includes the first inclined part 86, the upper wall 49 can guide the liquid toward the first recess part 61. The upper wall 49 may include a second inclined part 87 inclined downward toward the second opening 72. If the upper wall 49 includes the second inclined part 87, the upper wall 49 can guide the liquid toward the second opening 72. The grooves 67 may be provided in at least one of the first inclined part 86 and the second inclined part 87. If the grooves 67 are provided in the first inclined part 86 or the second inclined part 87, the liquid can be efficiently guided toward the first recess part 61 or the second opening 72.

Figure 15:
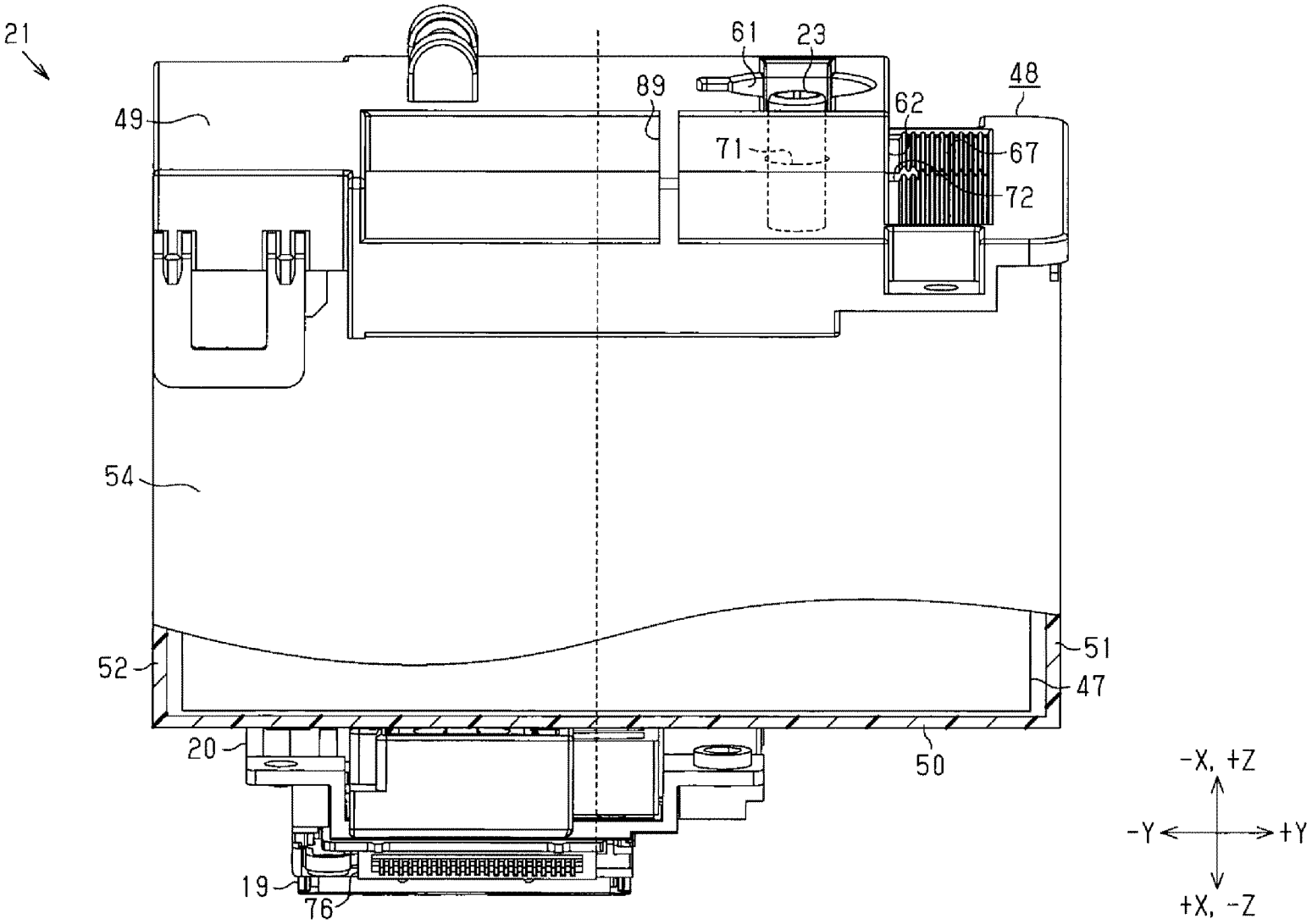
FIG. 15 is a perspective view of a third modified example of a liquid holding unit.

As illustrated in FIG. 15, a projecting wall 89, which is at least partially located between the liquid resupply unit 23 and the connector 76 with respect to the Y axis direction and projects upward, may be provided in the upper wall 49 (a third modified example). The projecting wall 89 may be provided extending in the X axis direction, or may be provided in a direction intersecting with the X axis direction. If the projecting wall 89 is provided between the liquid resupply unit 23 and the connector 76, the risk that liquid that has spilled to the surrounding areas of the liquid resupply unit 23 will flow toward the connector 76 can be reduced. This makes it possible to reduce the risk that liquid will land on the connector 76.

Figure 16:
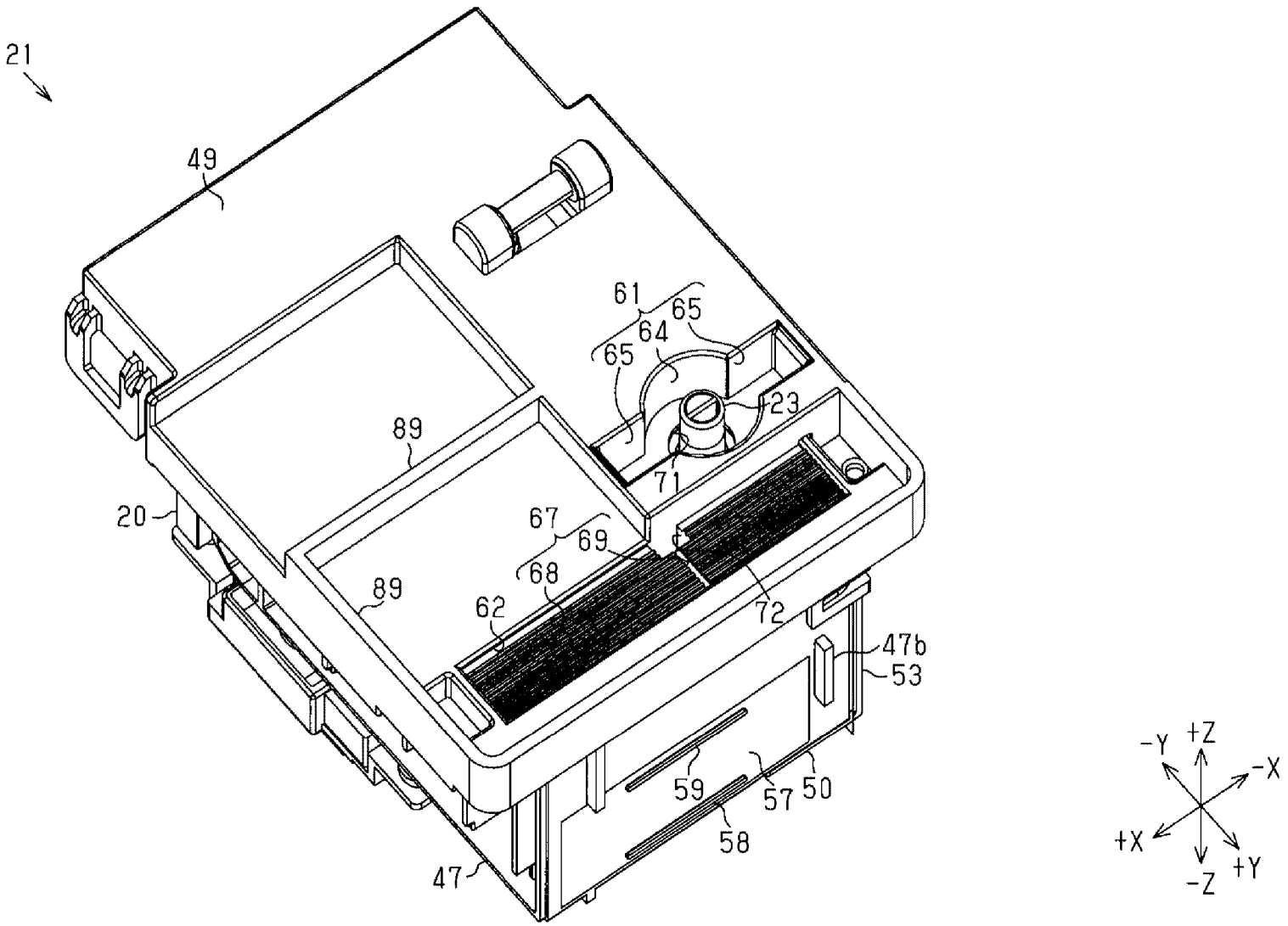
FIG. 16 is a perspective view of a fourth modified example of a liquid holding unit.

As illustrated in FIG. 16, a plurality of the projecting walls 89 may be provided in the upper wall 49 (a fourth modified example). For example, a projecting wall 89 extending in the X axis direction and a projecting wall 89 extending in the Y axis direction may be provided in the upper wall 49. If a plurality of the projecting walls 89 are provided in the upper wall 49, the risk that liquid that has spilled to the surrounding areas of the liquid resupply unit 23 will flow toward the connector 76 can be reduced.

Figure 17:
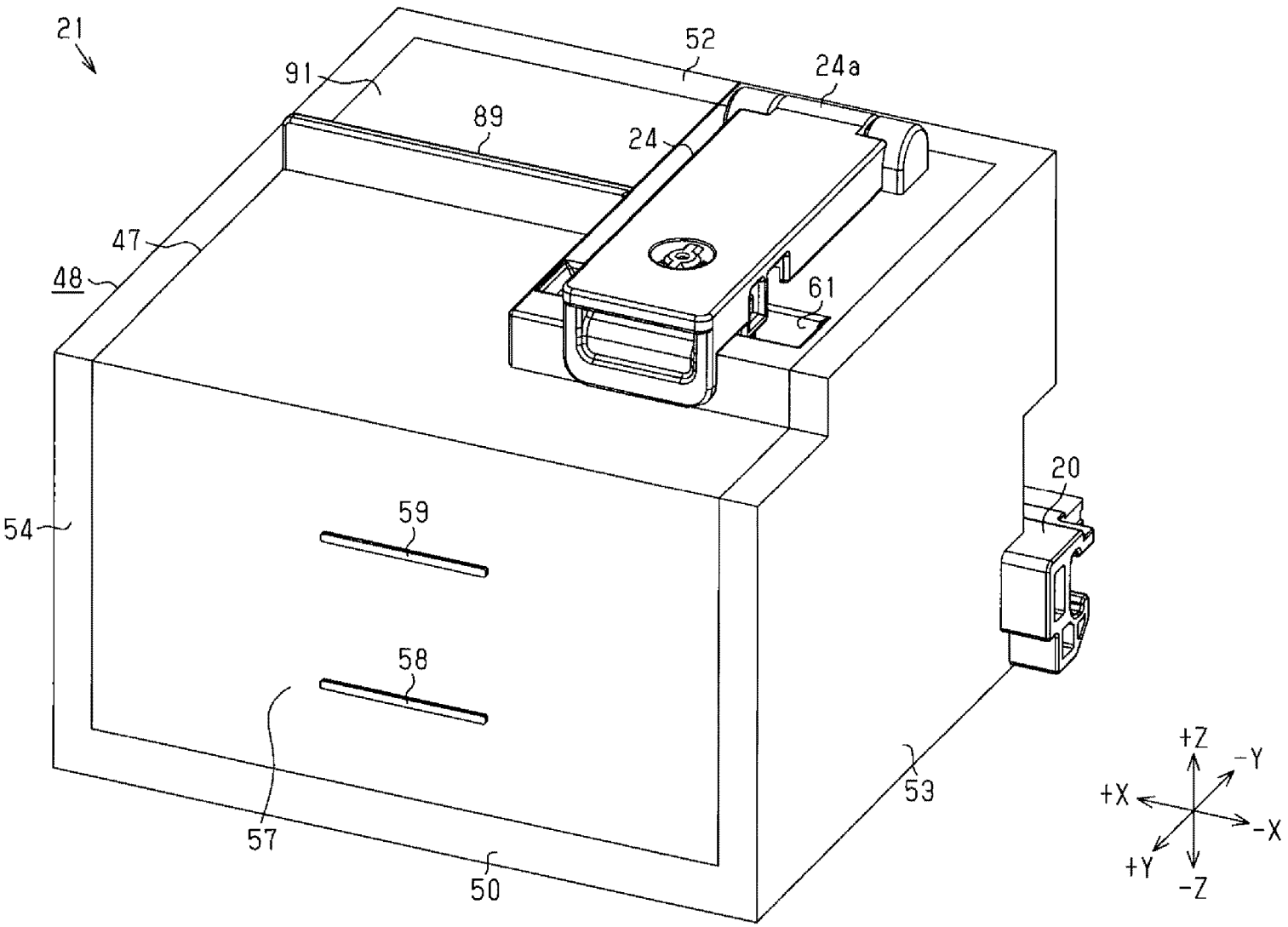
FIG. 17 is a perspective view of a fifth modified example of a liquid holding unit.
Figure 18:
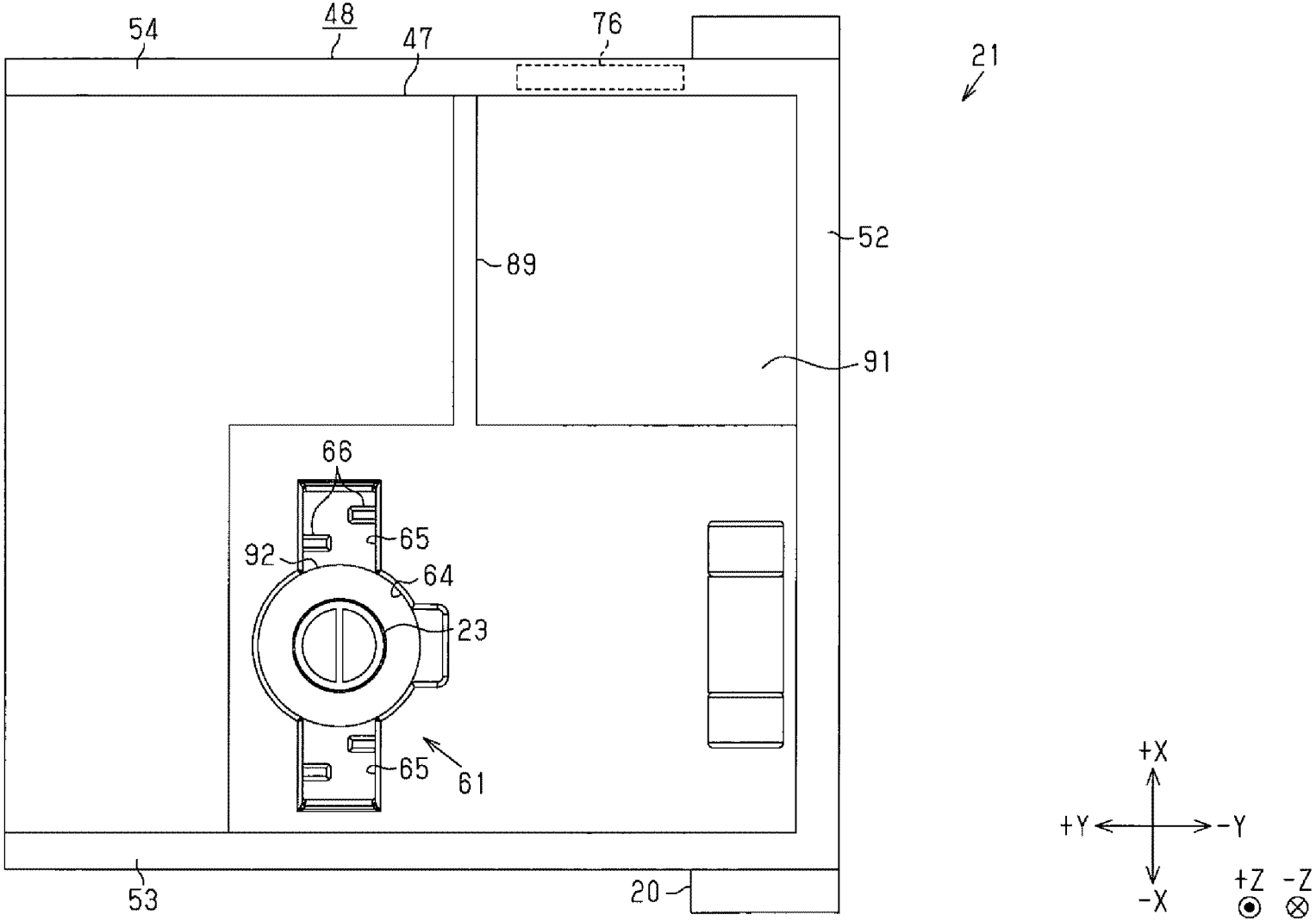
FIG. 18 is a plan view of the fifth modified example of a liquid holding unit.

As illustrated in FIGS. 17 and 18, the first recess part 61 may be provided in the liquid tank 47 (a fifth modified example). The liquid resupply unit 23 may be provided in the first recess part 61. In other words, the liquid tank 47 may be configured including the first recess part 61, which is provided in a resupply unit formation wall 91 in which the liquid resupply unit 23 is provided and which is recessed downward (in the −Z axis direction), in order to receive liquid that has spilled to the exterior of the liquid resupply unit 23. The resupply unit formation wall 91 is a wall defining an upper side of a liquid holding chamber (not shown) that holds liquid, and is a part located further upward than the upper limit display part 59.

The liquid tank 47 includes the first recess part 61 provided in the resupply unit formation wall 91, and the liquid resupply unit 23 is provided in the first recess part 61. Accordingly, liquid that has spilled to the exterior of the liquid resupply unit 23 can be taken into the first recess part 61. Situations where the surrounding areas are soiled by the spilled liquid can therefore be reduced. The first recess part 61 is longer in the X axis direction than in the Y axis direction, and thus the outer dimension of the liquid tank 47 with respect to the Y axis direction can be reduced.

As illustrated in FIG. 17, the liquid tank 47 may be provided with the cover 24.

As illustrated in FIG. 18, the nonplanar part 66 may be provided in the first recess part 61 included in the liquid tank 47.

As illustrated in FIG. 18, an absorption member 92 for absorbing liquid may be provided in the first recess part 61 included in the liquid tank 47. For example, an absorption member 92 having an annular shape may be provided so as to surround the liquid resupply unit 23. The size (thickness) of the absorption member 92 is smaller than the size (depth) of the first recess part 61 with respect to the Z axis direction. The absorption member 92 may be provided in part of the first recess part 61, or in the entirety of the first recess part 61, with respect to the X axis direction and the Y axis direction. The absorption member 92 may be provided in the rectangular recesses 65. Because the absorption member 92 is provided in the first recess part 61, liquid that has been received by the first recess part 61 can be absorbed by the absorption member 92. The risk of liquid leaking to the exterior of the first recess part 61 can therefore be reduced.

As illustrated in FIG. 18, the liquid resupply unit 23 and the first recess part 61 are preferably disposed further on the +Y axis direction side than the connector 76.

As illustrated in FIGS. 17 and 18, the projecting wall 89 may be provided in the resupply unit formation wall 91.

The housing 48 may be configured so as to not include at least one of the upper wall 49, the lower wall 50, the front wall 51, the rear wall 52, the right wall 53, and the left wall 54. In other words, the liquid ejecting apparatus 11 may be configured so as not to include the housing 48. FIG. 17 illustrates the housing 48 which does not include the upper wall 49 and the front wall 51.

The liquid resupply unit 23 may be positioned so that a leading end (upper end) thereof is positioned lower than the first opening 71. For example, the liquid resupply unit 23 may be a hole formed in the liquid tank 47.

The connector 76 may be located further toward the front side than, or in the same position as, at least one of the liquid resupply unit 23, the first recess part 61, the second recess part 62, the first opening 71, and the second opening 72 in the Y axis direction.

The slits 83 may not be provided in the absorption member 82. The liquid receiving part 74 may not include the projections 84.

The slits 83 may be holes in which inner walls thereof do not contact each other. The projections 84 may have shapes that ca n fit with those holes.

The first opening 71 may at least partially make contact with the absorption member 82.

In the liquid holding unit 21, the absorption member 82 may be provided within the second opening 72 as well. In other words, the entire second opening 72 may contact the absorption member 82.

The second opening 72 may not contact the absorption member 82.

The second opening 72 may be distanced from the absorption member 82.

The liquid receiving part 74 may have a configuration that does not include the absorption member 82.

The liquid holding unit 21 may include the absorption member 82 provided on an inner surface of the housing 48.

The liquid receiving part 74 may be located in a position shifted from at least one of the first opening 71 and the second opening 72. The liquid tank 47 may include a guide channel that guides the liquid from a position directly below the first opening 71 and the second opening 72 to the liquid receiving part 74.

The liquid tank 47 may have a configuration that does not include the liquid receiving part 74.

The housing 48 may include a liquid receiving part that, within the housing 48, receives liquid taken in from the first opening 71 and the second opening 72.

The liquid holding unit 21 may have a configuration in which the nonplanar part 66 is not provided.

At least one of the first recess part 61 and the second recess part 62 may have the same length in both the X axis direction and the Y axis direction. At least one of the first recess part 61 and the second recess part 62 may be shorter in the X axis direction than in the Y axis direction.

In the housing 48, the grooves 67 may be provided in a different position from the second recess part 62. The grooves 67 may be provided oriented toward the second recess part 62 so as to guide the liquid to the second opening 72.

The grooves 67 may be formed in the first recess part 61 to guide the liquid to the first opening 71.

The housing 48 may have a configuration including either the first recess part 61 and the first opening 71, or the second recess part 62 and the second opening 72.

The housing 48 may include, in a location of the upper wall 49 further toward the rear side than the liquid resupply unit 23, a recess part recessed downward, in order to receive liquid that has spilled to the exterior of the liquid resupply unit 23.

The housing 48 may have a configuration that does not include at least one of the first opening 71 and the second opening 72.

The housing 48 may have a configuration that includes either the first recess part 61 or the second recess part 62.

In the aforementioned embodiment, the liquid ejecting apparatus 11 may be a liquid ejecting apparatus that ejects and discharges a liquid aside from ink. Note that the state of the liquid ejected from the liquid ejecting apparatus as extremely fine droplets is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity, sol, gel water, other inorganic agents, organic agents, liquid solutions, liquid resins, and fluid states such as liquid metals (metallic melts). Furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. Liquid ejecting apparatuses that eject liquids including materials such as electrode materials, coloring materials, and so on in a dispersed or dissolved state for use in the manufacture and so on of, for example, liquid-crystal displays, EL (electroluminescence) displays, front emission displays, and color filters can be given as specific examples of liquid ejecting apparatuses. Alternatively, the liquid ejecting apparatus may be a liquid ejecting apparatus that ejects bioorganic matters used in the manufacture of biochips, a liquid ejecting apparatus that ejects liquids to be used as samples for precision pipettes, textile printing equipment, a microdispenser, and so on. Furthermore, the invention may be employed in liquid ejecting apparatuses that perform pinpoint ejection of lubrication oils into the precision mechanisms of clocks, cameras, and the like, as well as in liquid ejecting apparatuses that eject transparent resin liquids such as ultraviolet light-curable resins onto a substrate in order to form miniature hemispheric lenses (optical lenses) for use in optical communication elements. The invention may also be employed in a liquid ejecting apparatus that ejects an etching liquid such as an acid or alkali onto a substrate or the like for etching.

This application claims the benefit of foreign priority to Japanese Patent Application No. JP2017-228081, filed Nov. 28, 2017, which is incorporated by reference in its entirety.

What is claimed is:

1. A liquid ejecting apparatus, wherein assuming three spatial axes orthogonal to one another are an X axis, a Y axis, and a Z axis, directions following the X axis, the Y axis, and the Z axis are an X axis direction, a Y axis direction, and a Z axis direction, respectively, positive directions following the X axis, the Y axis, and the Z axis are a +X axis direction, a +Y axis direction, and a +Z axis direction, respectively, and negative directions following the X axis, the Y axis, and the Z axis are a −X axis direction, a −Y axis direction, and a −Z axis direction, respectively, and the vertical direction is the −Z axis direction, the liquid ejecting apparatus comprises:

a liquid tank, the liquid tank being mounted in a carriage configured to move back and forth in the X axis direction, and the liquid tank including a liquid resupply unit configured to accept resupply of a liquid from the exterior; and a housing configured to cover the liquid tank, wherein the housing includes:

a covering part that covers the liquid tank from the +Z axis direction;

a first recess provided in the covering part to receive a spilled liquid that has spilled to the exterior of the liquid resupply unit, and the recess being recessed in the −Z axis direction; and a second recess provided in the covering part to receive the spilled liquid that has spilled to the exterior of the liquid resupply unit, the second recess being recessed in the −Z axis direction and comprising a plurality of lateral grooves extending in the X axis direction and a longitudinal groove extending in the Y axis direction and intersecting the plurality of lateral grooves.

2. The liquid ejecting apparatus according to claim 1, wherein the first recess comprises a first opening to allow the liquid to pass in the −Z axis direction and the second recess comprises a second opening to allow the liquid to pass in the −Z axis direction, and wherein the liquid tank includes a liquid receiving part that receives the spilled liquid in at least part of the +Z axis direction.

3. The liquid ejecting apparatus according to claim 2, wherein each of the first recess and the second recess is longer in the X axis direction than in the Y axis direction.

4. The liquid ejecting apparatus according to claim 2, wherein the first recess further comprises a nonplanar part to engage with a resupply receptacle, the resupply receptacle holding the liquid to be resupplied to the liquid tank.

5. The liquid ejecting apparatus according to claim 2, wherein the first opening is provided in a position corresponding to the liquid resupply unit.

6. The liquid ejecting apparatus according to claim 2, wherein assuming that the covering part is taken as a first part, the housing includes a second part for covering the liquid tank from the +Y axis direction; and the second opening is provided in a position between the liquid resupply unit and the second part with respect to the Y axis direction.

7. The liquid ejecting apparatus according to claim 2, wherein the covering part includes an inclined part inclined in the −Z axis direction towards at least one of the first recess, the second recess, the first opening, or the second opening.

8. The liquid ejecting apparatus according to claim 7, wherein the plurality of lateral grooves are provided in the inclined part.

9. The liquid ejecting apparatus according to claim 2, wherein the first opening and the second opening are provided in a position corresponding to the liquid receiving part.

10. The liquid ejecting apparatus according to claim 9, wherein the liquid receiving part includes an absorption member that absorbs the spilled liquid.

11. The liquid ejecting apparatus according to claim 10, wherein the first opening and the second opening at least partially contact the absorption member.

12. The liquid ejecting apparatus according to claim 10, wherein at least one slit is provided in the absorption member; and the liquid receiving part further includes at least one projection, the projection corresponding to the slit and projecting in the +Z axis direction.

13. The liquid ejecting apparatus according to claim 2, further comprising:

a liquid ejecting head that ejects the liquid; and a circuit board electrically connected to the liquid ejecting head through a connector provided in the carriage, wherein the liquid resupply unit, the first recess, the second recess, the first opening, and the second opening are disposed further on the +Y axis direction side than the connector.

14. The liquid ejecting apparatus according to claim 13, wherein a projecting wall is provided in the covering part, the projecting wall being located at least partially between the liquid resupply unit and the connector with respect to the Y axis direction, and the projecting wall projecting in the +Z axis direction.

15. A liquid ejecting apparatus, wherein assuming three spatial axes orthogonal to one another are an X axis, a Y axis, and a Z axis, directions following the X axis, the Y axis, and the Z axis are an X axis direction, a Y axis direction, and a Z axis direction, respectively, positive directions following the X axis, the Y axis, and the Z axis are a +X axis direction, a +Y axis direction, and a +Z axis direction, respectively, negative directions following the X axis, the Y axis, and the Z axis are a −X axis direction, a −Y axis direction, and a −Z axis direction, respectively, and the vertical direction is the −Z axis direction, the liquid ejecting apparatus comprises:

a liquid tank, the liquid tank being mounted in a carriage configured to move back and forth in the X axis direction, and the liquid tank including a liquid resupply unit configured to accept resupply of a liquid from the exterior, wherein the liquid tank includes a first recess provided in a resupply unit formation wall in which the liquid resupply unit is provided, and the first recess being recessed in the −Z axis direction, in order to receive a spilled liquid that has spilled to the exterior of the liquid resupply unit;

wherein the liquid tank comprises a second recess recessed in the −Z axis direction to receive the spilled liquid that has spilled to the exterior of the liquid resupply unit, the second recess comprising a plurality of lateral grooves extending in the X axis direction and a longitudinal groove extending in the Y axis direction and intersecting the plurality of lateral grooves; and wherein the liquid resupply unit is provided in the first recess.

16. The liquid ejecting apparatus according to claim 15, wherein each of the first recess and the second recess is longer in the X axis direction than in the Y axis direction.

17. The liquid ejecting apparatus according to claim 15, wherein the first recess further comprises a nonplanar part to engage with a resupply receptacle, the resupply receptacle holding the liquid to be resupplied to the liquid tank.

18. The liquid ejecting apparatus according to claim 15, wherein an absorption member that absorbs the spilled liquid is provided in the first recess and the second recess.

19. The liquid ejecting apparatus according to claim 15, further comprising:

a liquid ejecting head that ejects the liquid; and a circuit board electrically connected to the liquid ejecting head through a connector provided in the carriage, wherein the liquid resupply unit, the first recess, and the second recess are disposed further on the +Y axis direction side than the connector.

20. The liquid ejecting apparatus according to claim 19, wherein a projecting wall is provided in the resupply unit formation wall, the projecting wall being located at least partially between the liquid resupply unit and the connector with respect to the Y axis direction, and the projecting wall projecting in the +Z axis direction.

* * * * *